US006796852B2

(12) United States Patent
Okamoto

(10) Patent No.: US 6,796,852 B2
(45) Date of Patent: Sep. 28, 2004

(54) CONNECTOR AND METHOD FOR PRODUCING THE SAME

(75) Inventor: Masaki Okamoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 244 days.

(21) Appl. No.: 10/202,032

(22) Filed: Jul. 23, 2002

(65) Prior Publication Data

US 2003/0017752 A1 Jan. 23, 2003

(30) Foreign Application Priority Data

Jul. 23, 2001 (JP) ..... 2001-221631
Aug. 9, 2001 (JP) ..... 2001-242797

(51) Int. Cl.[7] ..... H01R 13/405
(52) U.S. Cl. ..... 439/736; 439/516
(58) Field of Search ..... 439/516, 736, 439/733.1

(56) References Cited

U.S. PATENT DOCUMENTS 4,870,753 A * 10/1989 Pfeffer et al. ..... 29/884
5,017,164 A * 5/1991 Gibbs ..... 439/885
5,145,413 A * 9/1992 Okamoto et al. ..... 439/620
5,201,883 A * 4/1993 Atoh et al. ..... 29/883
5,653,611 A * 8/1997 Shibata et al. ..... 439/736
6,004,160 A * 12/1999 Korsunsky et al. ..... 439/660
6,007,387 A * 12/1999 Uchiyama ..... 439/736
2002/0061686 A1 * 5/2002 Ma et al. ..... 439/736

FOREIGN PATENT DOCUMENTS

DE 4423395 A1 * 11/1996
JP 63-211577 9/1988
JP 2000-251999 * 9/2000

* cited by examiner

*Primary Examiner*—Michael C. Zarroli
(74) *Attorney, Agent, or Firm*—Gerald E. Hespos; Anthony J. Casella

(57) ABSTRACT

In a process of secondary insert molding, a molten resin is injected into a cavity (236) for secondary molding that is formed by bring a clipping portion (234) of a mold for secondary molding into contact with an outer surface of a primary molding article (216). Projecting areas of ends (214A) of terminals (214) on an outer surface of a resin molding portion (210) are formed of a primary molding resin portion (219). Thus, the cavity (236) for secondary molding and clipping portion (234) are in a position where the ends (214A) of the terminals (214) do not contact the cavity (236) and clipping portion (234).

14 Claims, 22 Drawing Sheets

CONNECTOR AND METHOD FOR PRODUCING THE SAME

BACKGROUND OF THE INVENTION

1. Field of the Invention

This invention relates to a connector produced by insert molding and a method for producing the connector.

2. Description of the Related Art

A connector produced by integrating a plurality of terminals with a housing by insert molding is disclosed, for example, in Japanese Patent Public Disclosure No. SHO 63-211577 (1988). The insert molding method places the terminals in a mold and then injects resin into the mold and around the terminals. However, it is inefficient to set a plurality of terminals one by one in a mold.

Accordingly, the terminals are connected through carriers to form a linked terminal. This process is effected by setting a linked terminal in a mold for primary molding, integrating the linked terminal with a primary molding portion by insert molding, and producing a primary molding article with the carriers exposed. Then, the carriers are cut off to separate the terminals from each other. The primary molding article is set in a mold for secondary molding to effect secondary molding. A secondary molding portion covers the carriers and terminals to form a secondary molding article. Thus, a connector is obtained from the secondary molding article.

To avoid a short circuit between the terminals in the above process, the carriers in the primary molding article are cut off. Heretofore, the carriers have been cut off over wide areas to define a great clearance between remaining portions of the adjacent terminals. However, the greater this cutting area is, the larger the cut chip becomes. If the cut chips are blended into a mold for secondary molding, the cut chips will cause short circuits between the terminals.

A connector having ends of terminals projecting from an outer surface of a resin molding portion has been known and is identified by the numeral 300 in FIG. 27 herein. The prior art connector 300 includes a primary molding article 301 integrating terminals 303 with a primary molding resin portion 302 by means of primary insert molding. A resin molding portion 305 is formed by integrating the primary molding article 301 with a secondary molding resin portion 104 by means of secondary insert molding. Ends 303A of the terminals 303 extend outward from the outer surface of the resin molding portion 305.

If the connector is produced through the two processes, a mold 306 for secondary molding is provided with a clipping portion 307 that contacts the outer surface of the primary molding article 301. The clipping portion 307 defines a cavity 308 for secondary molding enclosed by the outer surface of the primary molding article 301 and the inner surface of the mold 306 for secondary molding. A molten resin is injected into the cavity 308 for secondary molding to form a secondary molding resin portion 304.

The secondary molding resin portion 304 of the conventional connector 300 surrounds the projecting areas of the terminals 303 on the outer surface of the resin molding portion 305. Thus, it is necessary to bring the clipping portion 307 of the mold 306 for secondary molding into contact with the terminals 303 in the part of the clipping portion 307 corresponding to the projecting areas of the terminals 303. Consequently, it is necessary to provide narrow holes 309 in the clipping portion 307 for receiving the ends 303A of the terminals 303. This results in a complicated structure in the mold 306 for secondary molding.

In view of the above problems, a first object of the present invention is to surely prevent a short circuit between terminal members upon cutting off carriers between the terminal members. A second object of the present invention is to simplify a structure of a mold for secondary molding.

SUMMARY OF THE INVENTION

The present invention is directed to a connector and to a method for producing a connector wherein a linked terminal is formed by coupling a plurality of terminals to each other by carriers. A primary molding article is formed by integrating the linked terminal with a primary molding portion by a primary insert molding. The terminal members then are separated from each other by cutting off the carriers. The connector is formed by integrating the primary molding article having the cut-off carriers with a secondary molding portion by means of secondary insert molding. The connector is characterized in that the carriers are cut along single cutting lines of severance, and remaining portions of the cut carriers are bent to separate adjacent terminals from each other.

Since each carrier is cut along a single cutting line of severance, a cut chip is not produced. Accordingly, it is possible to prevent the terminals from causing a short circuit due to inclusion of the cut chips into the secondary molding portion. Also, the remaining portions caused by cutting the carriers are deformed and bent to separate the adjacent terminals from each other. Consequently, any short circuit between the terminals due to direct contact of the remaining portions can be avoided.

The invention also is directed to a connector produced by projecting ends of terminals from an outer surface of a resin molding portion. The terminals are integrated with a primary molding resin portion by means of primary insert molding to form a primary molding article. A cavity for secondary molding is enclosed by an outer surface of the primary molding article and an inner surface of a mold for secondary molding. A clipping portion is provided on the mold for secondary molding being brought into contact with the outer surface of the primary molding article. A molten resin is injected into the cavity for secondary molding to form a secondary molding resin portion that integrates the secondary molding resin portion with the primary molding article. The connector is characterized in that the ends of the terminals project from the exposed regions of the primary molding resin portion that are not covered by the secondary molding resin portion.

A linked terminal that has a plurality of terminals connected by carriers may be integrated with the primary molding resin portion by means of primary insert molding. Escape holes may be provided in the primary molding resin portion at areas corresponding to the carriers. The carriers are cut off above the escape holes to separate the terminals away from each other, and secondary insert molding is effected. The secondary molding resin portion entering the escape hole insulates the terminals separated by cutting off the carriers.

The primary molding resin portion may be coupled to the secondary molding resin portion on the outer surface in which an end of each escape hole is open. The escape holes and secondary molding resin portion are provided with latches that restrain separation of the primary and secondary molding resin portions by engagement of the latches.

The primary molding article may be formed by piling a plurality of primary molding assemblies in axial directions of the escape holes. Each primary molding assembly may be formed by integrating the terminals with a primary molding resin element by means of primary insert molding.

The invention also is directed to a method for producing a connector having ends of terminals projecting from an outer surface of a resin molding portion. The method comprises integrating the terminals with a primary molding resin portion by means of primary insert molding to form a primary molding article. The method continues by defining a cavity for secondary molding enclosed by an outer surface of the primary molding article and an inner surface of a mold for secondary molding with a clipping portion provided on the mold for secondary molding being brought into contact with the outer surface of the primary molding article. The method proceeds by injecting a molten resin into the cavity for secondary molding to form a secondary molding resin portion; and integrating the secondary molding resin portion with the primary molding article. Ends of the terminals project from exposed regions of the primary molding resin portion.

The ends of the terminals project from the primary molding resin portion. Thus, the secondary molding resin portion and cavity for secondary molding are disposed in an area different from the projecting areas of the terminals and the clipping portion of the mold for secondary molding also is at a position where the terminals do not contact the mold. Accordingly, it is not necessary to provide narrow holes for receiving the ends of the terminals in the clipping portion, thereby simplifying the structure of the mold for secondary molding.

The terminals can be set in the mold for primary insert molding in the form of the linked terminal in which the carriers connect the terminals. Thus, workability is improved in comparison with a conventional setting work of the individual terminals. Also, the carriers are cut off in the escape holes. Therefore, it is not necessary to remove a part of the primary molding resin portion in association with cutting off the carriers, thereby eliminating waste of materials. Since the secondary molding resin portion is between the terminals separated by cutting the carriers to insulate the terminals, it is possible to insulate the respective terminals from each other.

The latches are provided on the escape holes and secondary molding resin portion to engage the portions, even if the ends of the escape holes are joined to the secondary molding resin portion at the surface on which the ends are open. Thus, it is possible to restrain the primary and secondary molding portions from separating from each other.

If the terminal members are piled in the axial directions of the escape holes when the primary molding portions of the primary molding article are formed as a single piece, it will be impossible to open the mold, since the terminals interfere with forming of the escape holes.

With respect to the above matter, in the present invention, the primary molding assemblies in which the terminal members and primary molding resin elements are integrated by primary insert molding are piled in the axial directions of the escape holes to form the primary molding article. Consequently, it is not necessary to align the terminals to pile them in the axial directions of the escape holes. The terminals do not interfere with the opening action of the mold upon forming the escape holes.

BRIEF DESCRIPTION OF THE DRAWINGS

The foregoing and other features of the present invention will become apparent to one skilled in the art to which the present invention relates upon consideration of the invention with reference to the accompanying drawings, wherein.

DETAILED DESCRIPTION OF THE PREFERRED EMBODIMENTS

By referring now to FIGS. 1 through 11 a first embodiment of the present invention will be described below.

A connector A embodying the present invention is formed by integrating a synthetic resin housing 110 and a plurality of L-shaped terminals 121 together with each other by means of insert molding. In the following description, "front side" refers to the left side in FIGS. 1 to 3 and FIG. 10 hereinafter. The terms "upper side" refer to the vertical direction in FIGS. 4 to 11 hereinafter.

Figure 10:
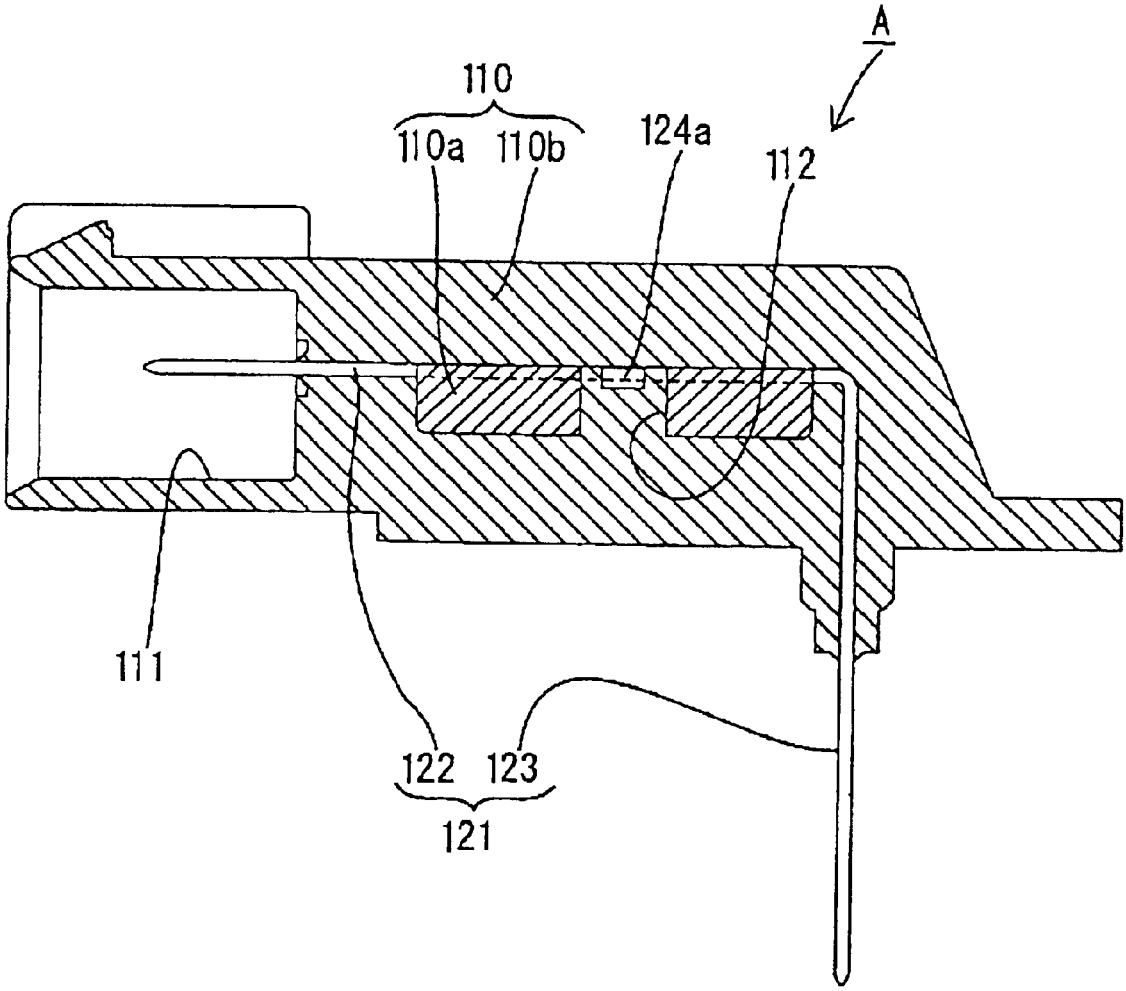
FIG. 10 is a longitudinal sectional view of the connector of the present invention.
Figure 11:
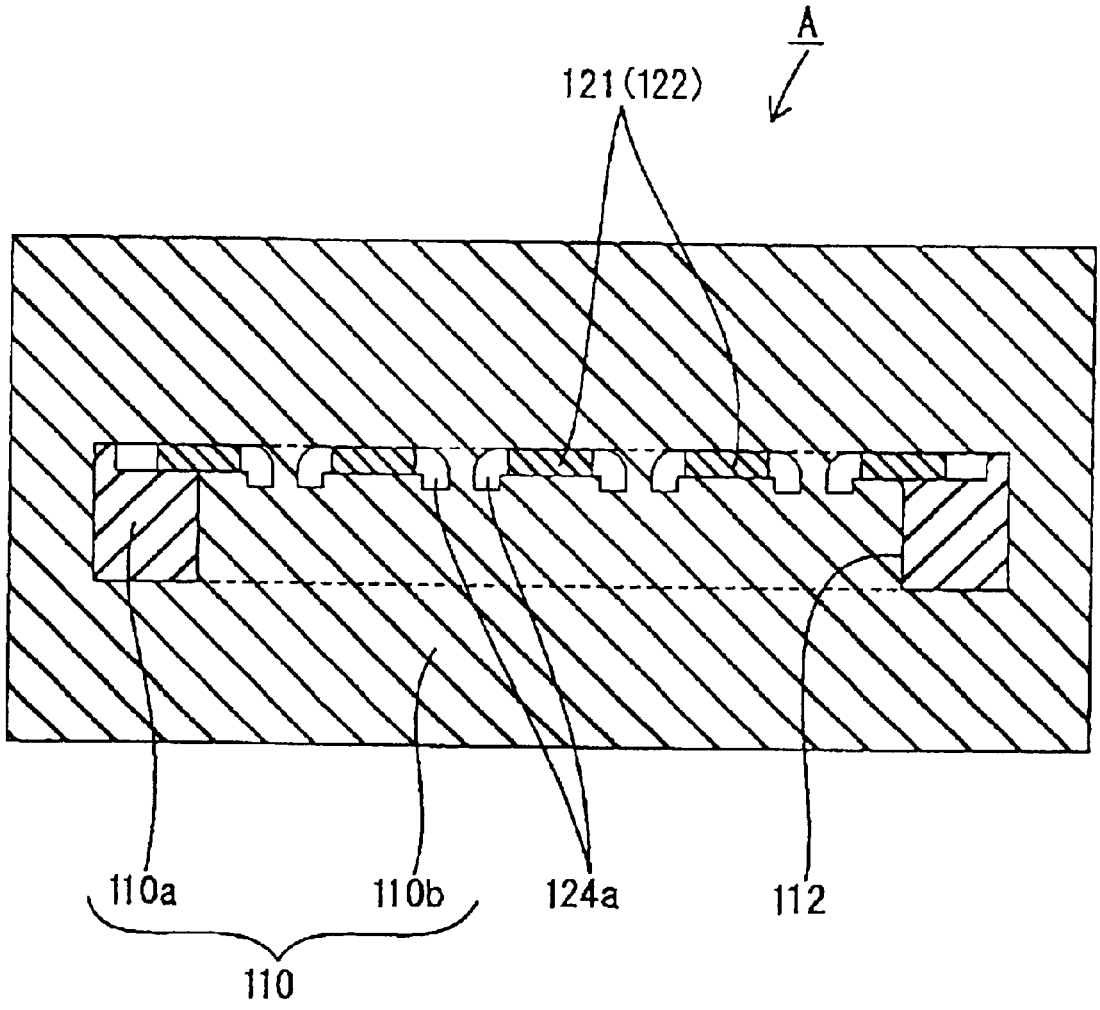
FIG. 11 is a cross sectional view of the connector shown in FIG. 10.

Each terminal 121 includes a horizontal portion 122 that extends straight in the lateral direction and a vertical portion 123 that extends down straight at a right angle from a rear end of the horizontal portion 122, as shown in FIG. 10. The terminals 121 extend through the housing 110 with the horizontal portions 122 and vertical portions 123 being juxtaposed, respectively. Front ends of the horizontal portions 122 of the terminals 121 are disposed in a fitting recess 111 formed in a front end of the housing 110 while the vertical portions 123 extend outwardly through a bottom wall of a rear end of the housing 110.

Figure 1:
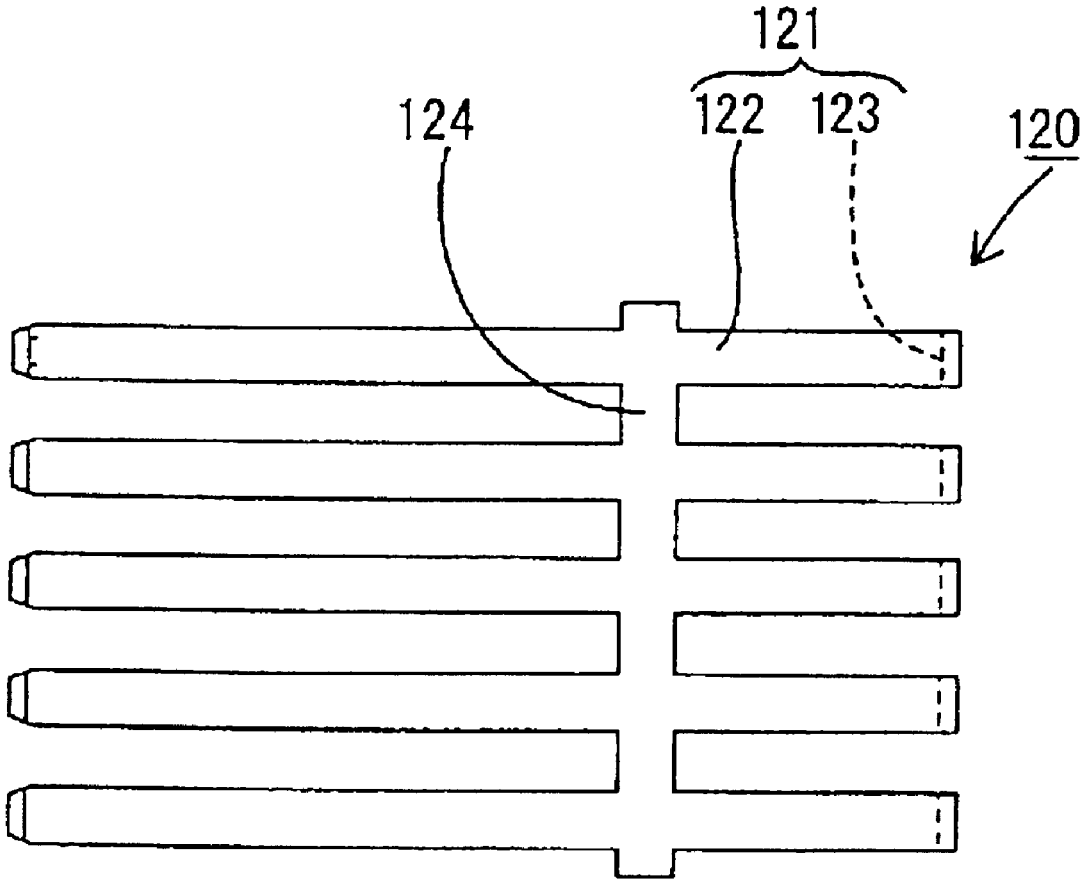
FIG. 1 is a plan elevation view of a linked terminal in a first embodiment of a connector in accordance with the present invention.
Figure 2:
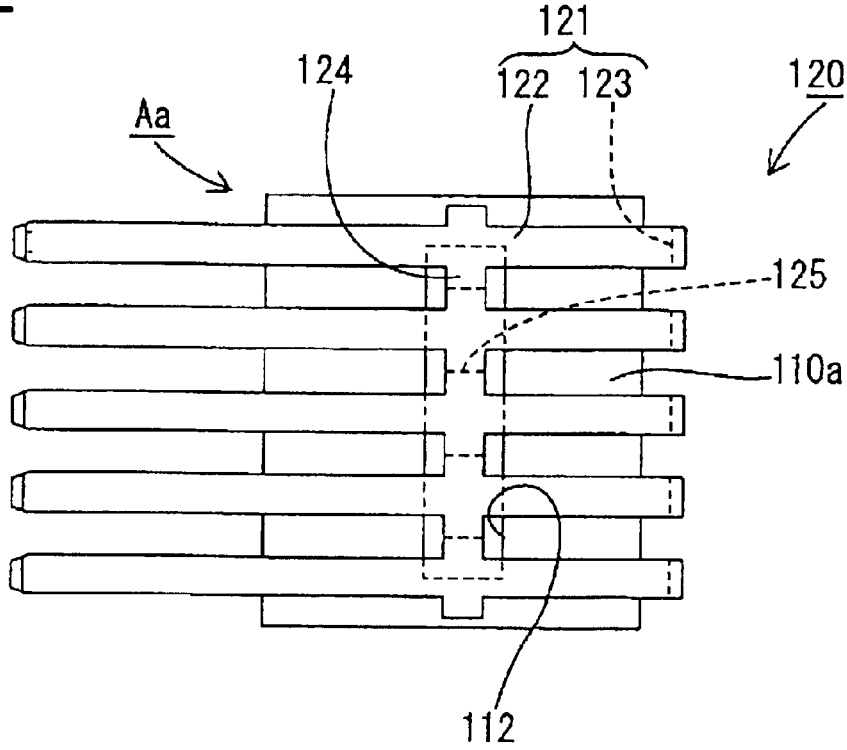
FIG. 2 is a plan elevation view of a primary molding article integrated with the linked terminal by primary insert molding.
Figure 3:
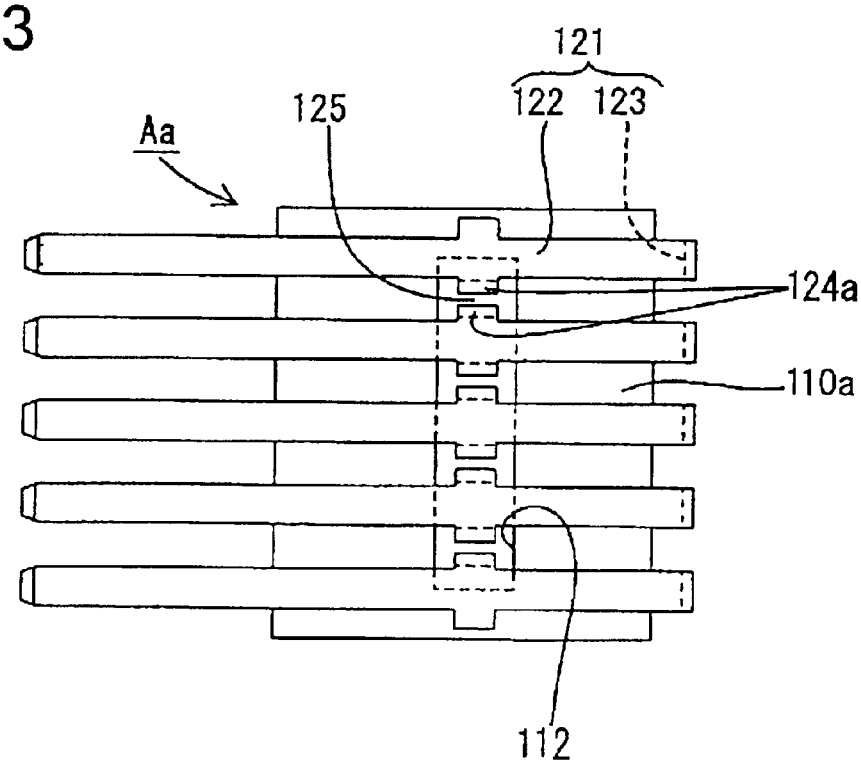
FIG. 3 is a plan elevation view of the primary molding article in which carriers are cut off.
Figure 9:
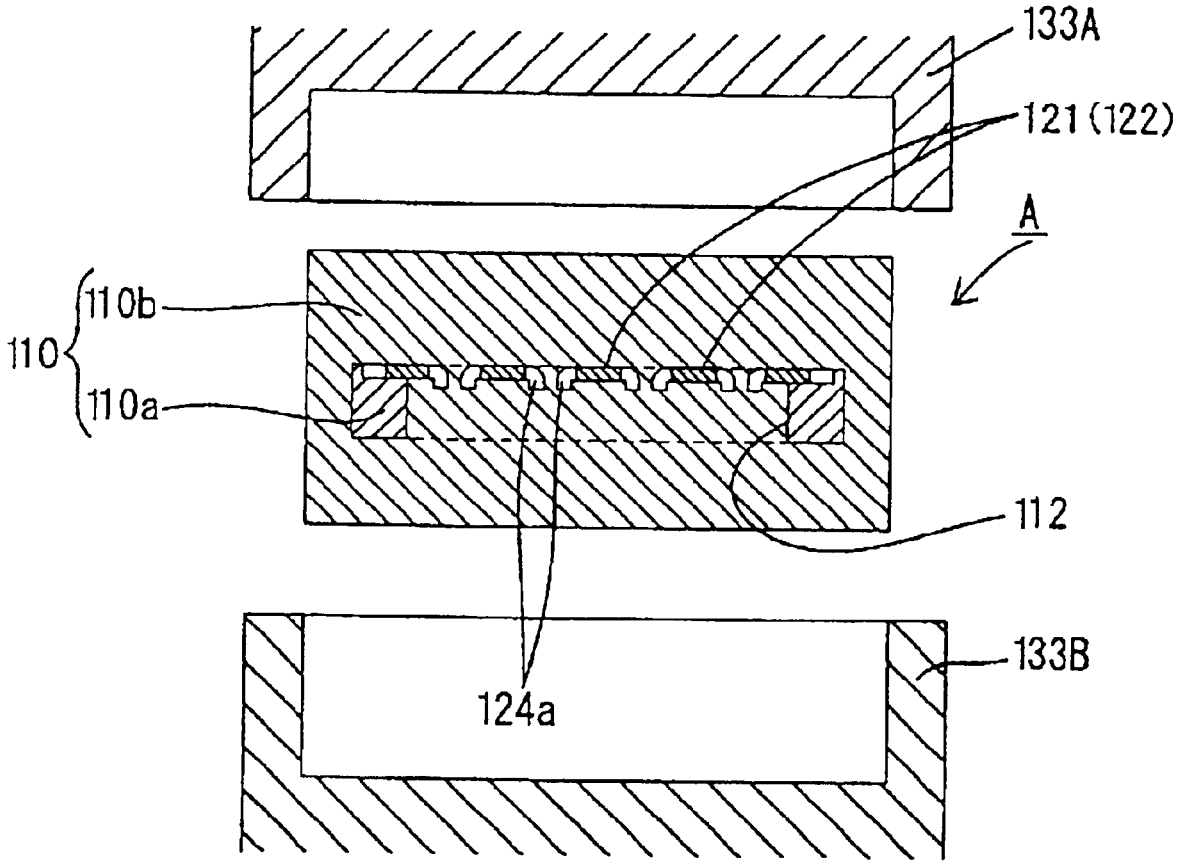
FIG. 9 is a cross sectional view of a connector produced by secondary molding, illustrating a position of the connector after removing it from the mold for secondary molding.

Briefly, the connector A of the present invention is formed by providing a plurality of terminals 121 that are coupled to each other by carriers 124 to define a linked terminal 120, as shown in FIG. 1. The linked terminal 110 is integrated with a primary molding portion 110*a* that constitutes the housing 110 by means of primary insert molding to form a primary molding article Aa, as shown in FIG. 2. The carriers 124 then are cut off to separate the terminals 121 from each other, as shown in FIG. 3. The primary article Aa having the cut-off carriers 124 then is integrated with a secondary molding portion 110*b* by means of secondary insert molding, as shown in FIGS. 9 and 10.

Next, a process of producing the connector of the present invention will be described in greater detail below.

As shown in FIG. 1, a linked terminal 120 has a plurality of terminals 121 juxtaposed vertically at a given pitch. A carrier 124 couples the horizontal portions 122 of the adjacent terminals 121 to each other. Each carrier 124 is a square plate and is contiguous and coplanar with the horizontal portion 122. An intermediate product (not shown) of the linked terminal 120 is produced by stamping a metallic plate by a press to form the horizontal portions 122 and vertical portions 123 along straight lines and to couple the horizontal portions 122 to each other through the carriers 124. Then, the vertical portions 123 of the intermediate product are bent down at a right angle with respect to the horizontal portions 122.

Figure 4:
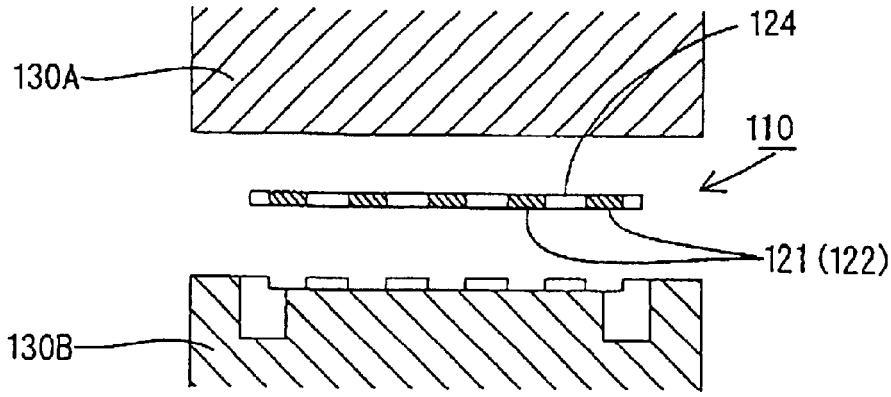
FIG. 4 is a cross sectional view of the linked terminal, illustrating a position of the terminal before setting it in a mold for primary molding.
Figure 5:
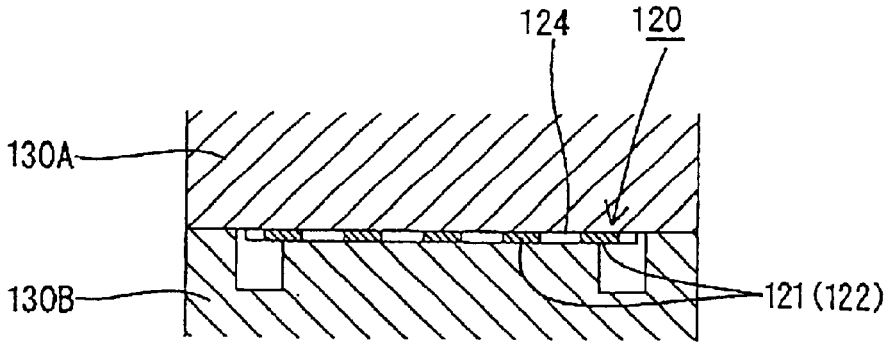
FIG. 5 is a cross sectional view of the linked terminal, illustrating a position of the terminal after setting it in the mold for primary molding.
Figure 6:
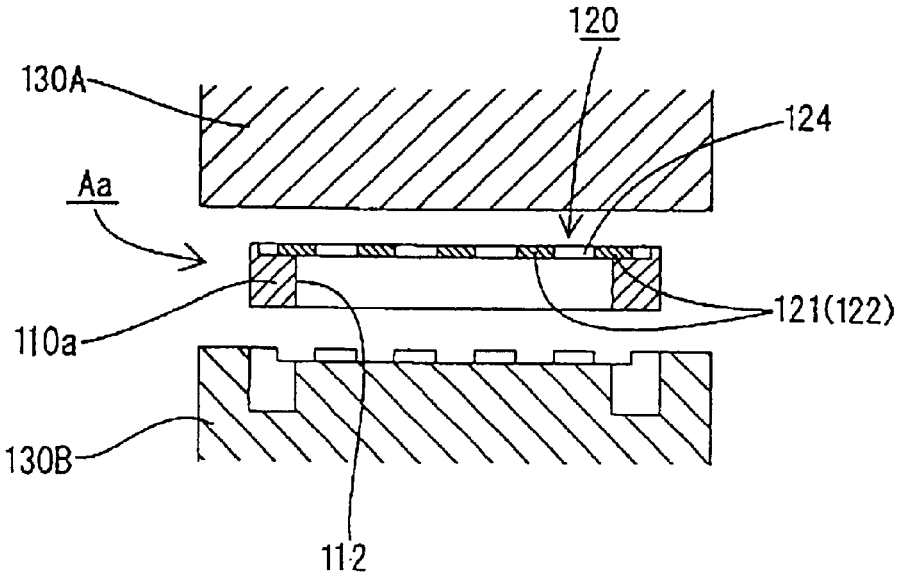
FIG. 6 is a cross sectional view of a primary molding article, illustrating a position of the article after removing it from the mold for primary molding.

The linked terminal 120 is set in a pair of molds 130A and 130B for primary molding (see FIGS. 4 and 5). A primary molding article Aa (see FIGS. 2 and 6) is obtained by integrating the linked terminal 120 with a primary molding portion 110*a* by means of primary insert molding. Thus, a unitary matrix of a resin or other nonconductive material is defined around portions of the linked terminal. The primary molding article Aa is arranged on a generally square block-like primary molding portion 110*a* with the horizontal portions 122 and carriers 124 being exposed and juxtaposed thereon. An elongated escape hole 112 is formed in the primary molding portion 110*a* at the area corresponding to the carriers 124. Front ends of the horizontal portions 122 extend forward over a front end of the primary molding portion 110*a* while rear ends of the horizontal portions 122 and the vertical portion 123 extend rearward over a rear end of the primary molding portion 110*a*.

Figure 7:
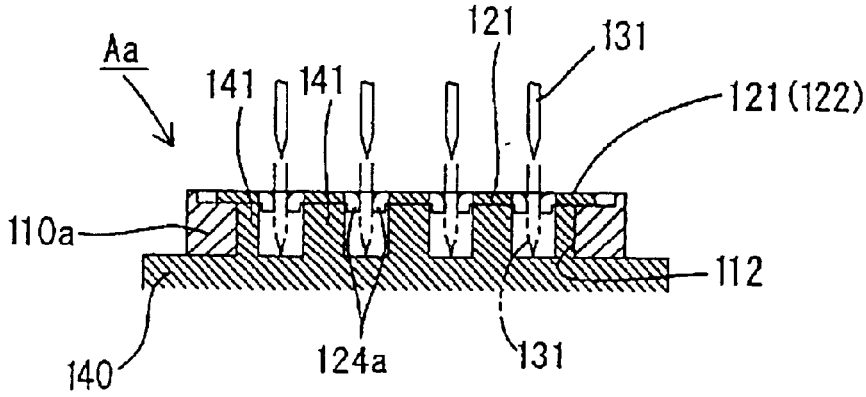
FIG. 7 is a cross sectional view of the primary molding article, illustrating a step of cutting off carriers of the article.
Figure 8:
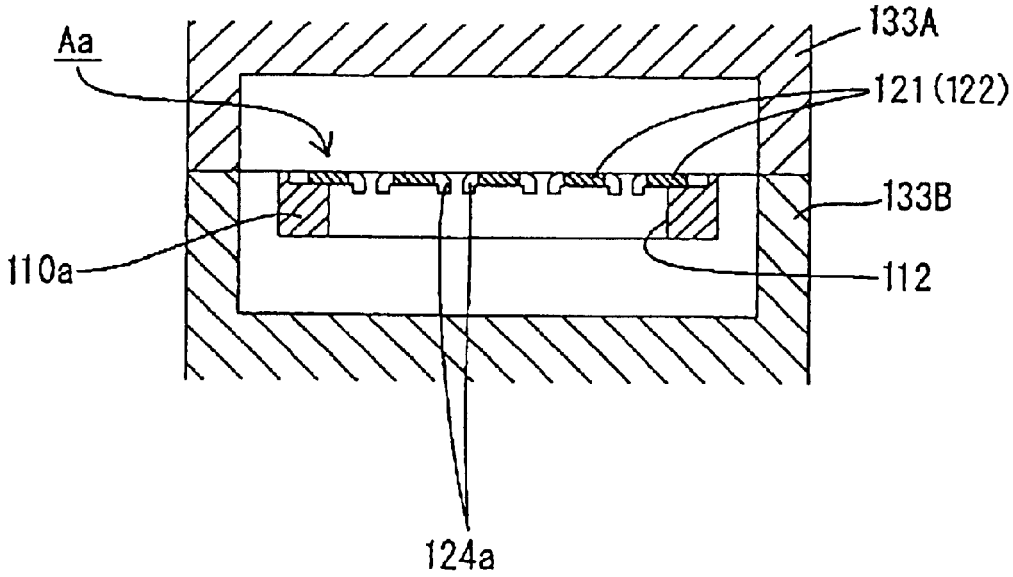
FIG. 8 is a cross sectional view of the primary molding article, illustrating a position of the article after setting it in a mold for secondary molding.

Next, cutters 131 cut the carriers 124 along imaginary cutting lines 125 (see FIGS. 2 and 3). Remaining portions 124*a* of the carriers 124 are deformed downward at a right angle as part of the cutting process to extrude from side edges of the horizontal portions 122 (see FIGS. 7 and 8), thereby separating the adjacent terminals 121 from each other. In order to prevent the terminals 121 from being deformed downward when cutting off and deforming down the carriers 124, as shown in FIG. 7, the primary molding article Aa is put on a lower mold 140 and receiving portions 141 of the lower mold 140 enter the escape hole 112 and support the bottom surface of the terminal members 121. Each imaginary cutting line 125 is set to be a center of each carrier 124 in a vertical direction (see FIG. 2). Each cutter 131 cuts off the carrier 124 along the imaginary cutting line 125 and deforms a pair of the remaining portions 124*a* symmetrically. Thus, the remaining portions 124*a* are spaced from each other. Since the escape hole 112 is provided in the primary molding portion 110*a* at the area corresponding to the carriers 124, the cutters 131 do not interfere with the primary molding portion 110*a*.

The primary molding article Aa to which a process of cutting and bending the carriers 124 has been applied is set in a pair of molds 133A and 133B for secondary molding (see FIG. 8) to effect secondary insert molding. In the secondary insert molding step, a secondary molding portion 110*b* is integrated with the primary molding article Aa so that the secondary molding portion 110*b* encloses the primary molding portion 110*a* and fills the escape hole 112 and the spaces between the remaining portions 124*a* with a unitary matrix of resin or other nonconductive material. Thus, a process of producing a connector A as the secondary molding article is finished (see FIG. 9).

In the embodiment described above, each carrier 124 is cut along a single imaginary cutting line 125. Thus, a cut chip is not produced. Accordingly, a short circuit will not be caused by an inclusion of cut chips in the secondary molding portion.

Each carrier 124 is cut off along a single line 125 without causing any cut chips. Consequently, the pair of remaining portions 124*a* are adjacent to each other immediately after cutting the carriers 124. However, the cutter 131 bends down the remaining portions 124*a* to separate the portions 124*a* away from each other after cutting off the carrier 124 along the imaginary cutting line 125. Consequently, the remaining portions 124*a* of the carrier 124 do not contact each other and any short circuit between the terminals 121 due to direct contact of the remaining portions 124*a* does not occur.

The remaining portions 124*a* bite a part of the secondary molding portion 110*b* that enters the escape hole 112. In the embodiment described above, since each carrier 124 is cut off along a single imaginary cutting line 125 without cut chips, it is possible to set a relatively long length by which the remaining portions 124*a* project from the terminal member 121, that is, a relatively deep depth by which the remaining portions 124*a* bite the secondary molding portion 110*b*. Accordingly, even if an external force is applied to the terminals 121 in a longitudinal direction (lateral direction) of the horizontal portions 122, the biting of the remaining portions 124*a* into the secondary molding portion 110*b* prevents the terminals 121 from displacing laterally. In addition, since the remaining portions 124*a* are projected from the side edges of the horizontal portions 122 and are bent downward at a substantially right angle with respective to the plate, even if an external force is applied to the terminals 121 in a width direction of the terminals 121, it is possible to prevent the terminals 121 from displacing widthwise.

Although the carrier is cut off at the central position in the above embodiment, the carrier may be cut off at an offset position near either terminal.

Two remaining portions are made in the carrier by cutting off the carrier in the above embodiment. However, a single remaining portion may be made by setting an imaginary cutting line along a side edge of the terminal member and by cutting the carrier along the line.

Two remaining portions made in the carrier by cutting off the carrier are bent together in the above embodiment. However, any one of the remaining portions may be bent in accordance with the present invention.

Although two remaining portions made in the carrier by cutting off the carrier are bent together in the same direction in the above embodiment, the remaining portions may be bent in opposite directions.

Although two remaining portions are bent at a substantially right angle in the above embodiment, the remaining portions may be bent back or bent in U-shape in accordance with the present invention.

A second embodiment of a connector in accordance with the present invention will be described below by referring to FIGS. 12 through 26.

Figure 14:
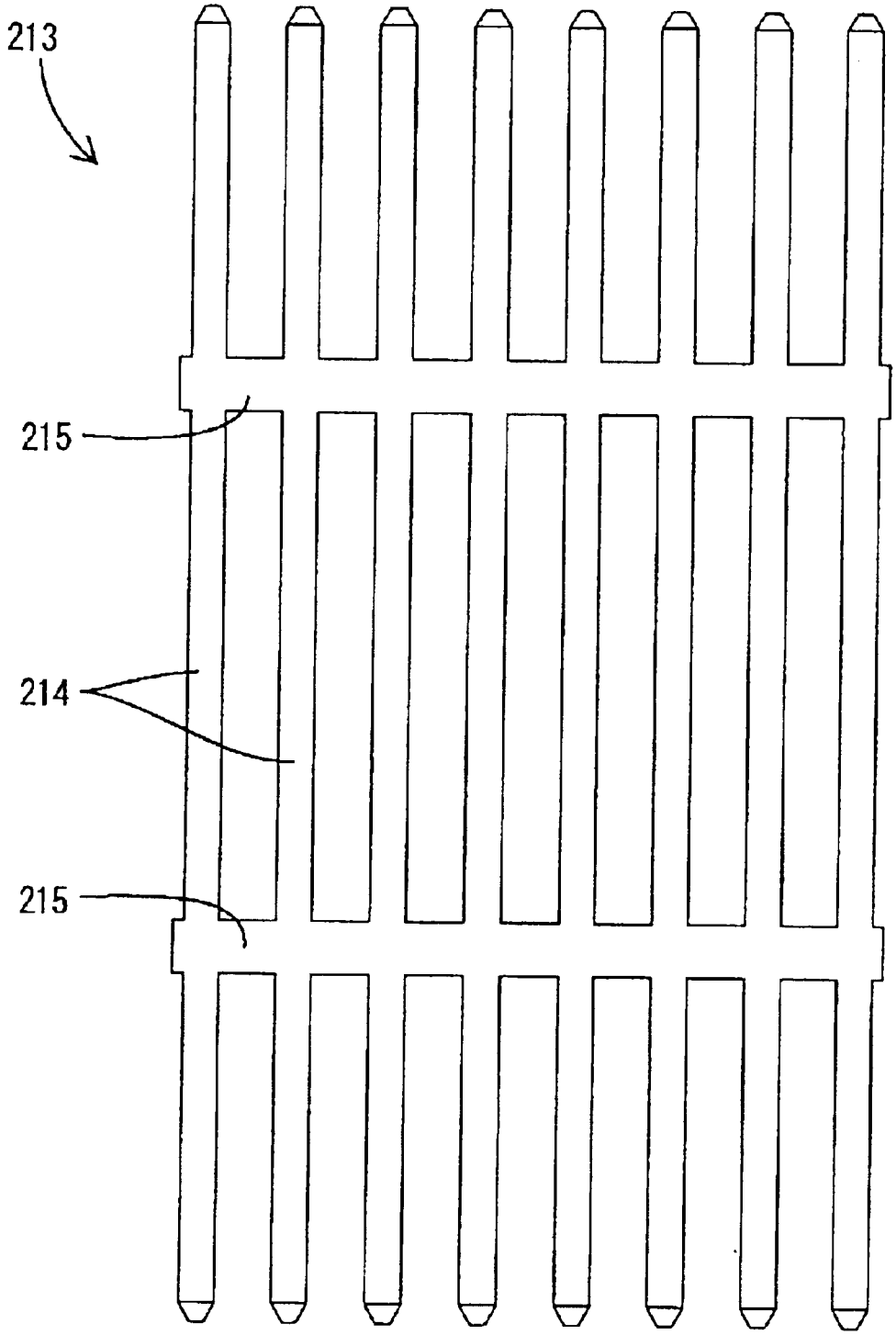
FIG. 14 is a front elevation view of a linked terminal.
Figure 15:
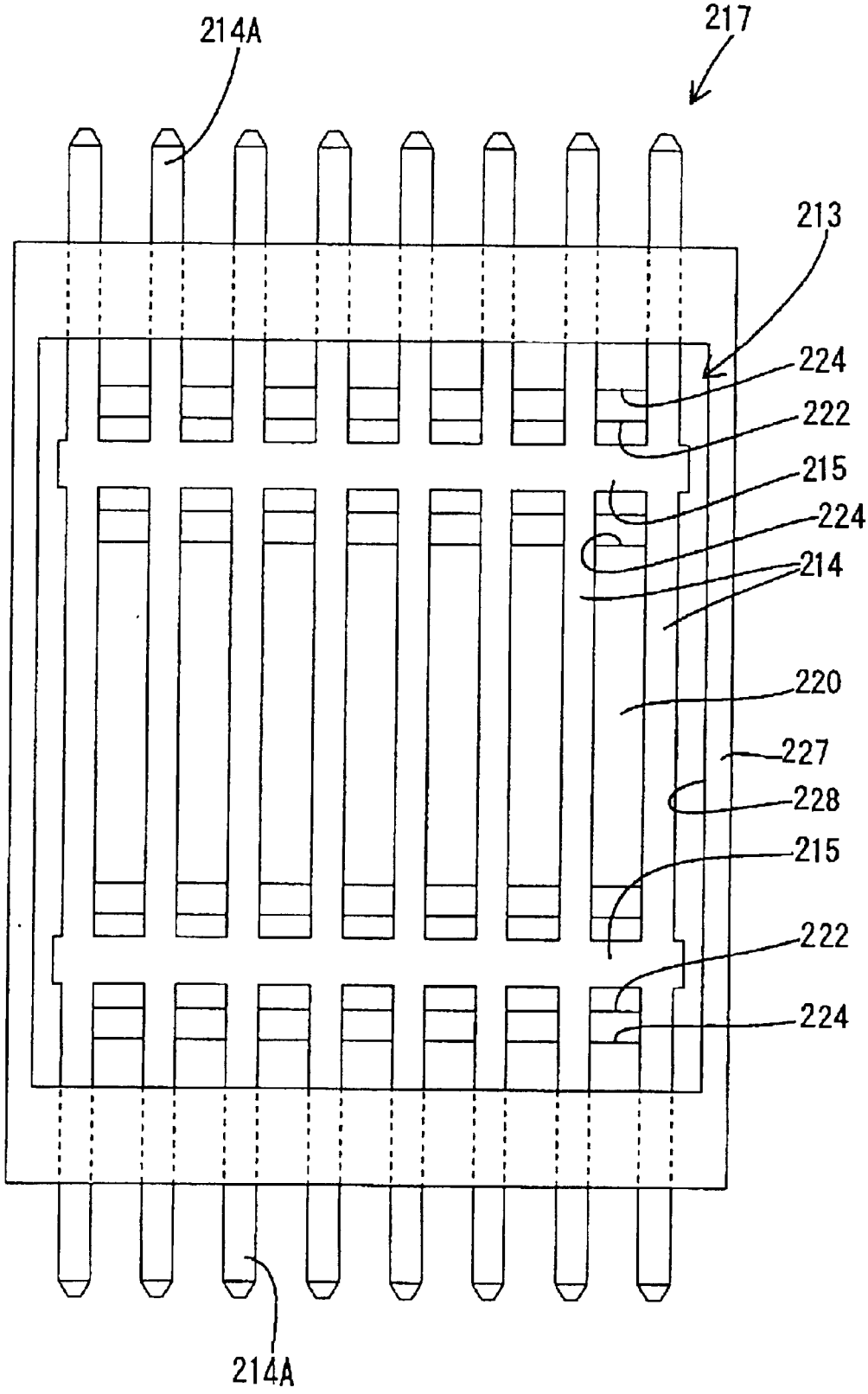
FIG. 15 is a front elevation view of a primary molding assembly.
Figure 16:
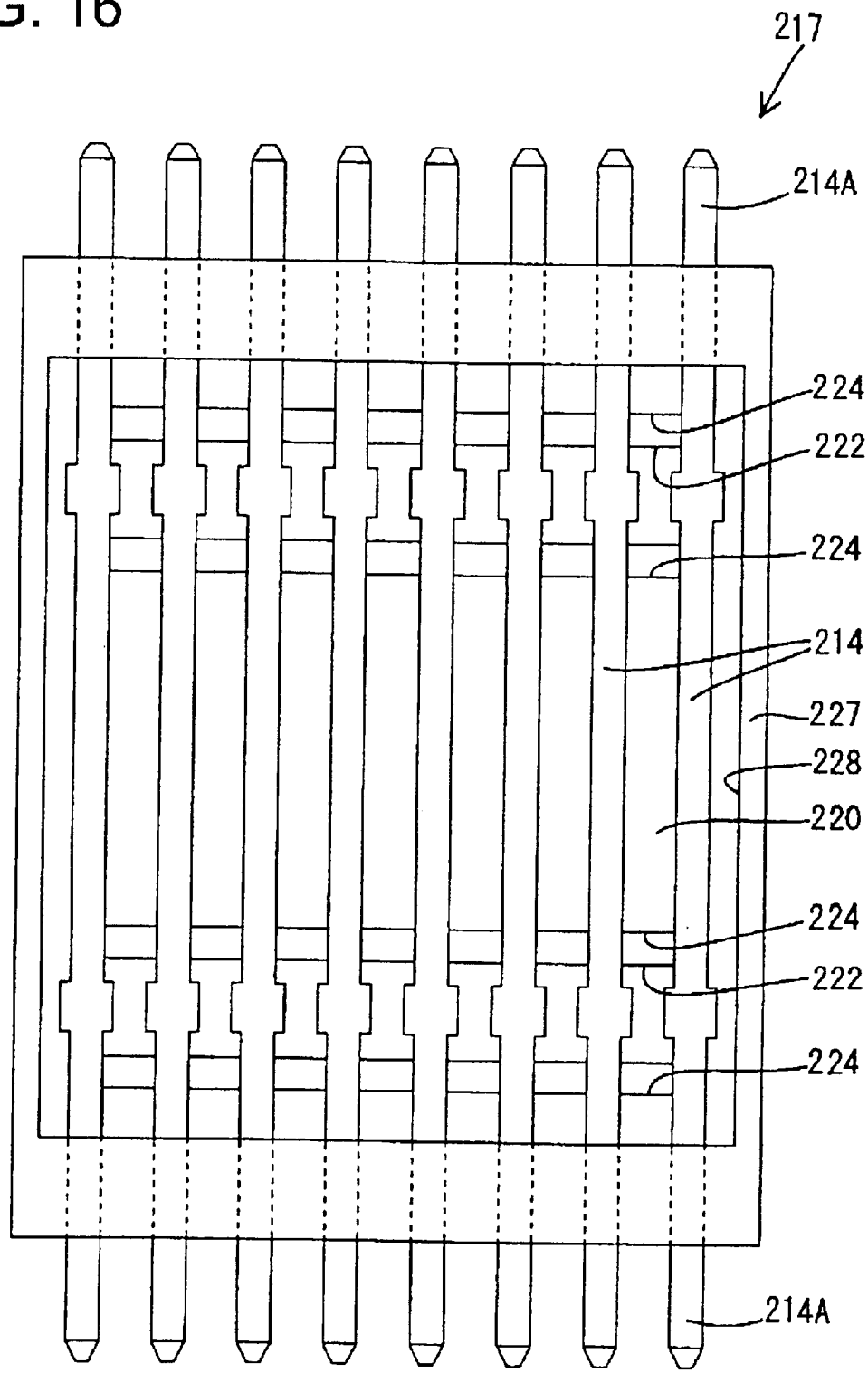
FIG. 16 is a front elevation view of a first primary molding assembly, illustrating carriers being cut off from the article.
Figure 17:
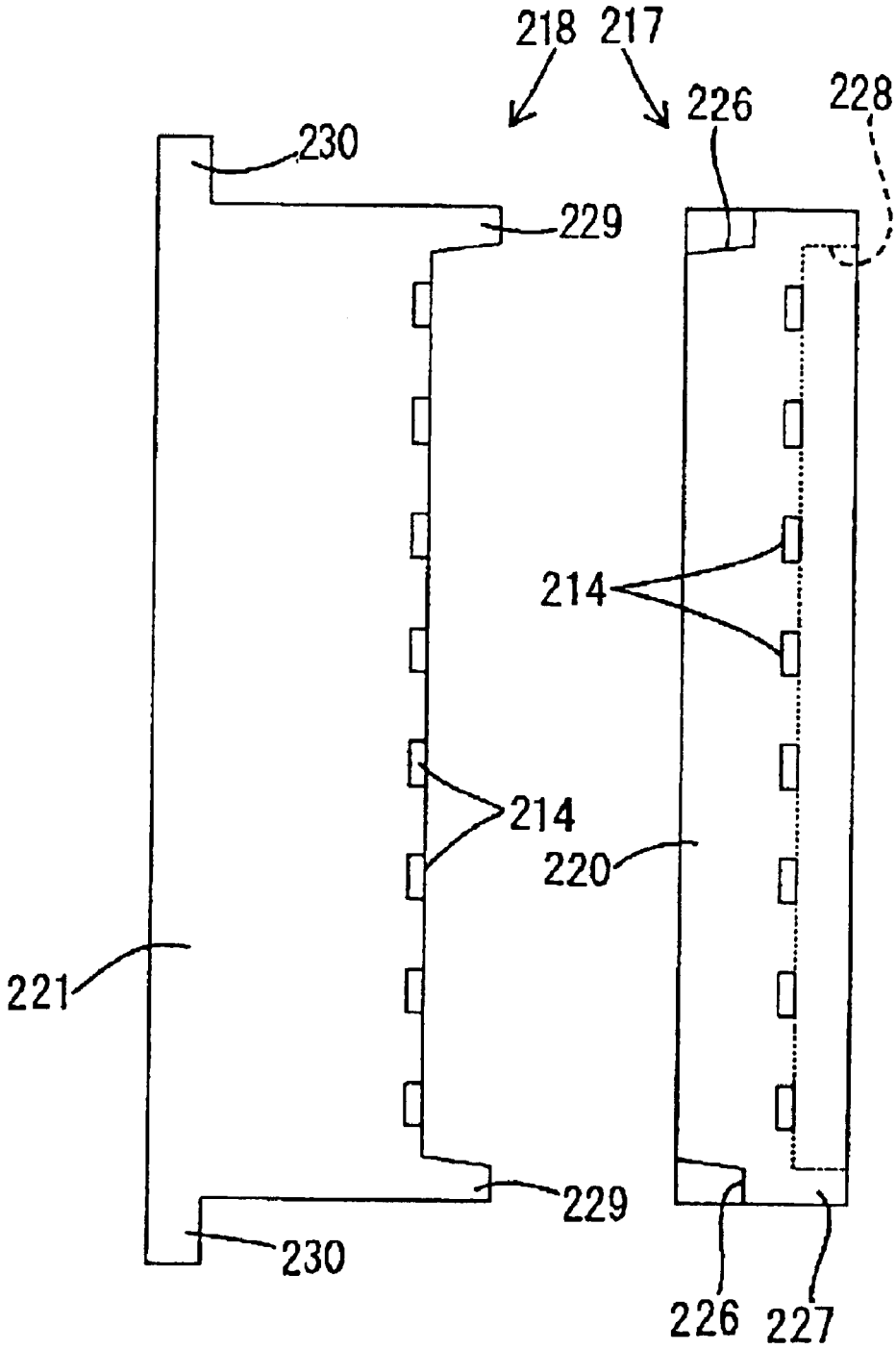
FIG. 17 is a plan elevation view of first and second primary molding assemblies in a separated position.
Figure 18:
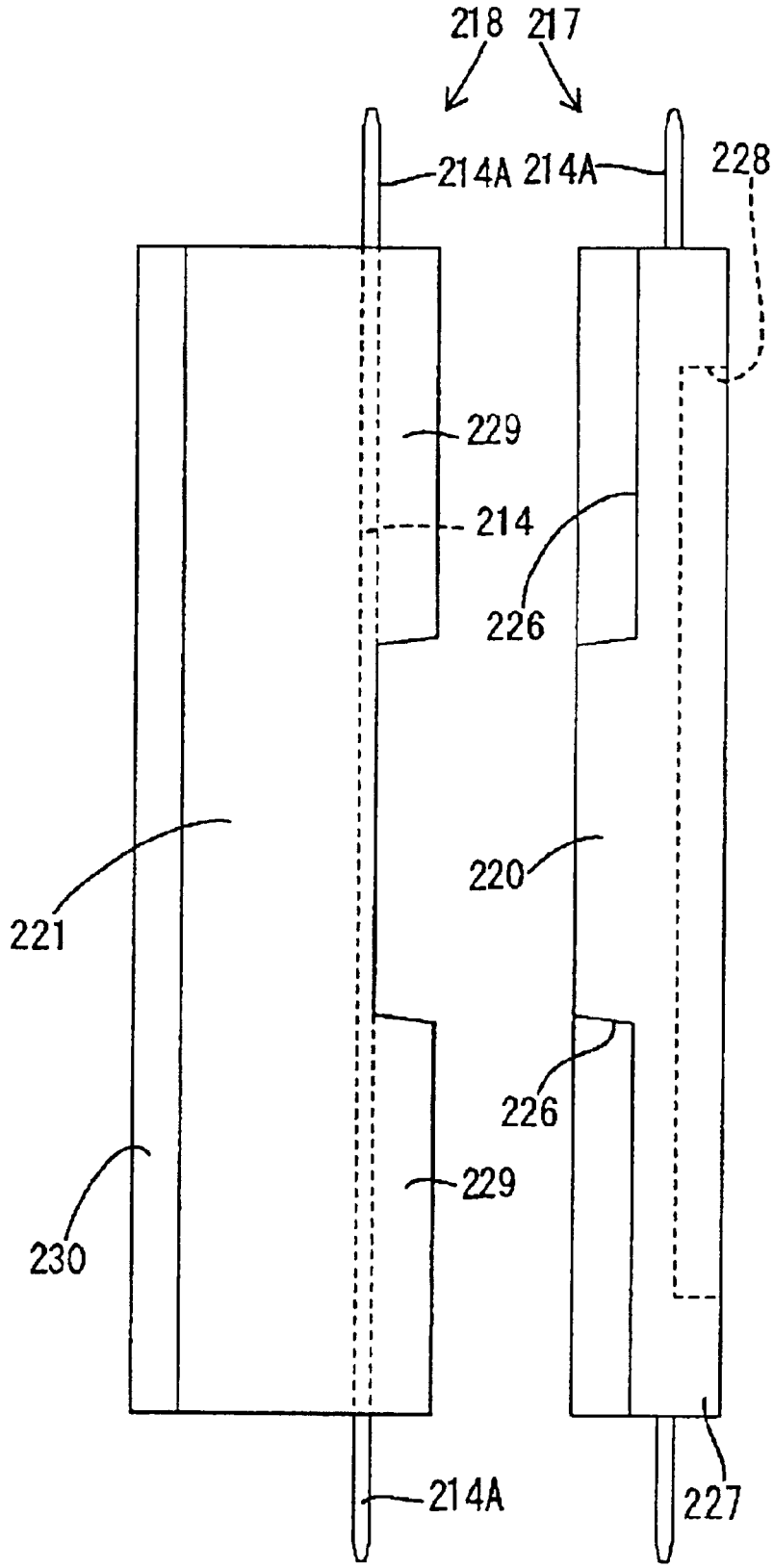
FIG. 18 is a side elevation view of the first and second primary molding assemblies in the separated position.
Figure 19:
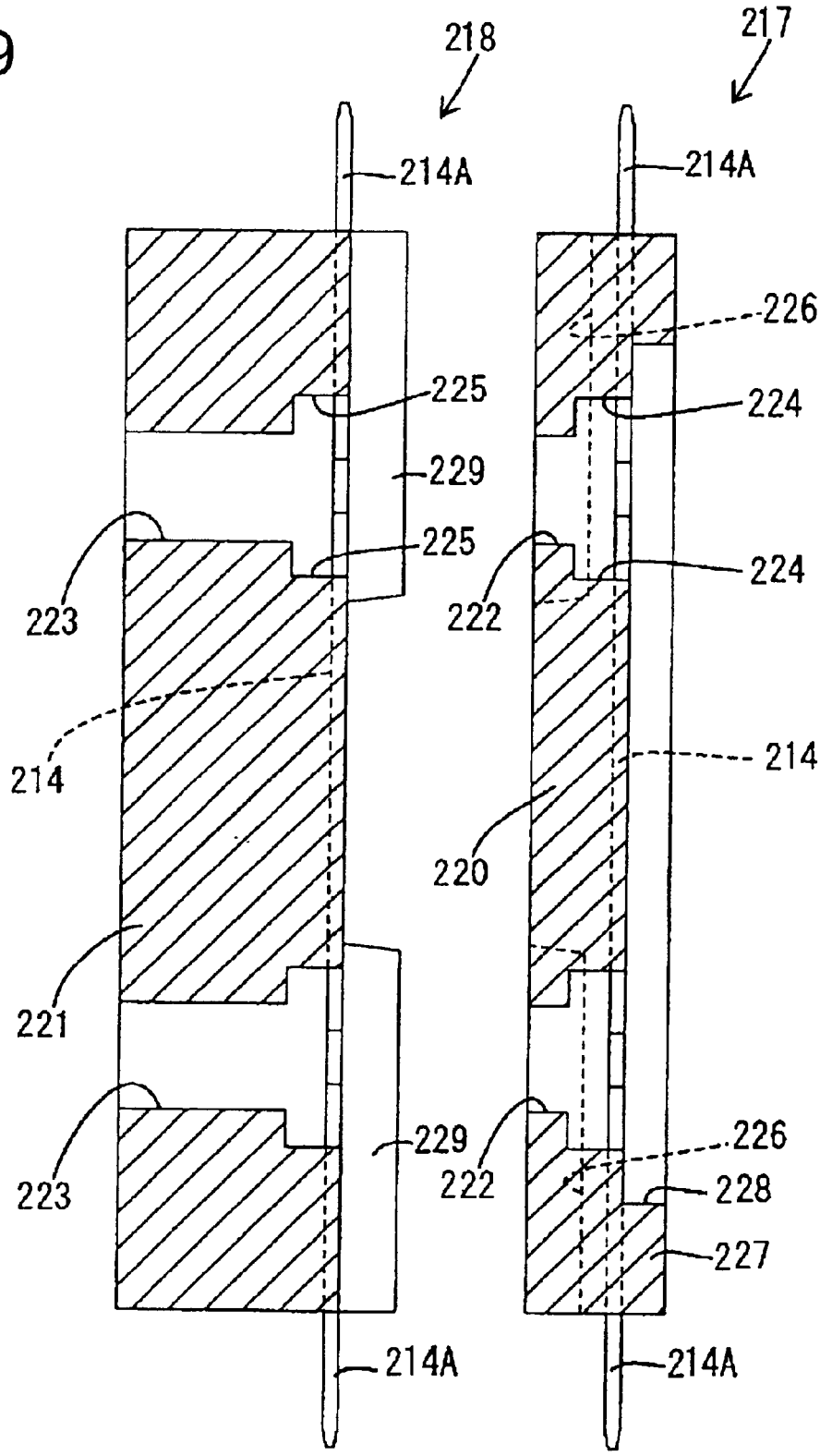
FIG. 19 is a longitudinal cross sectional view of the first and second primary molding assemblies in the separated position.
Figure 21:
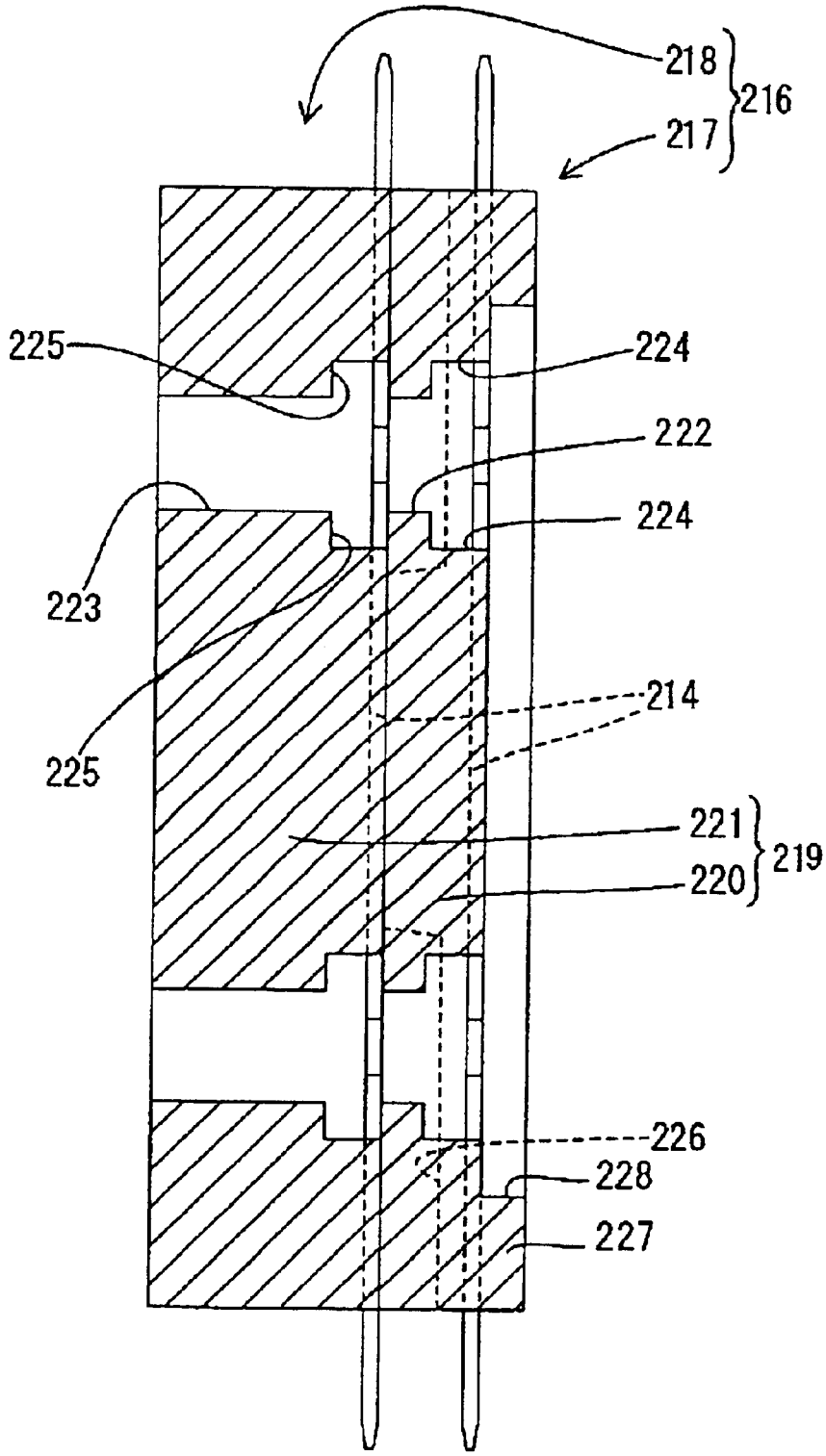
FIG. 21 is a cross sectional view of a single primary molding article that combines the first and second primary molding assemblies.
Figure 22:
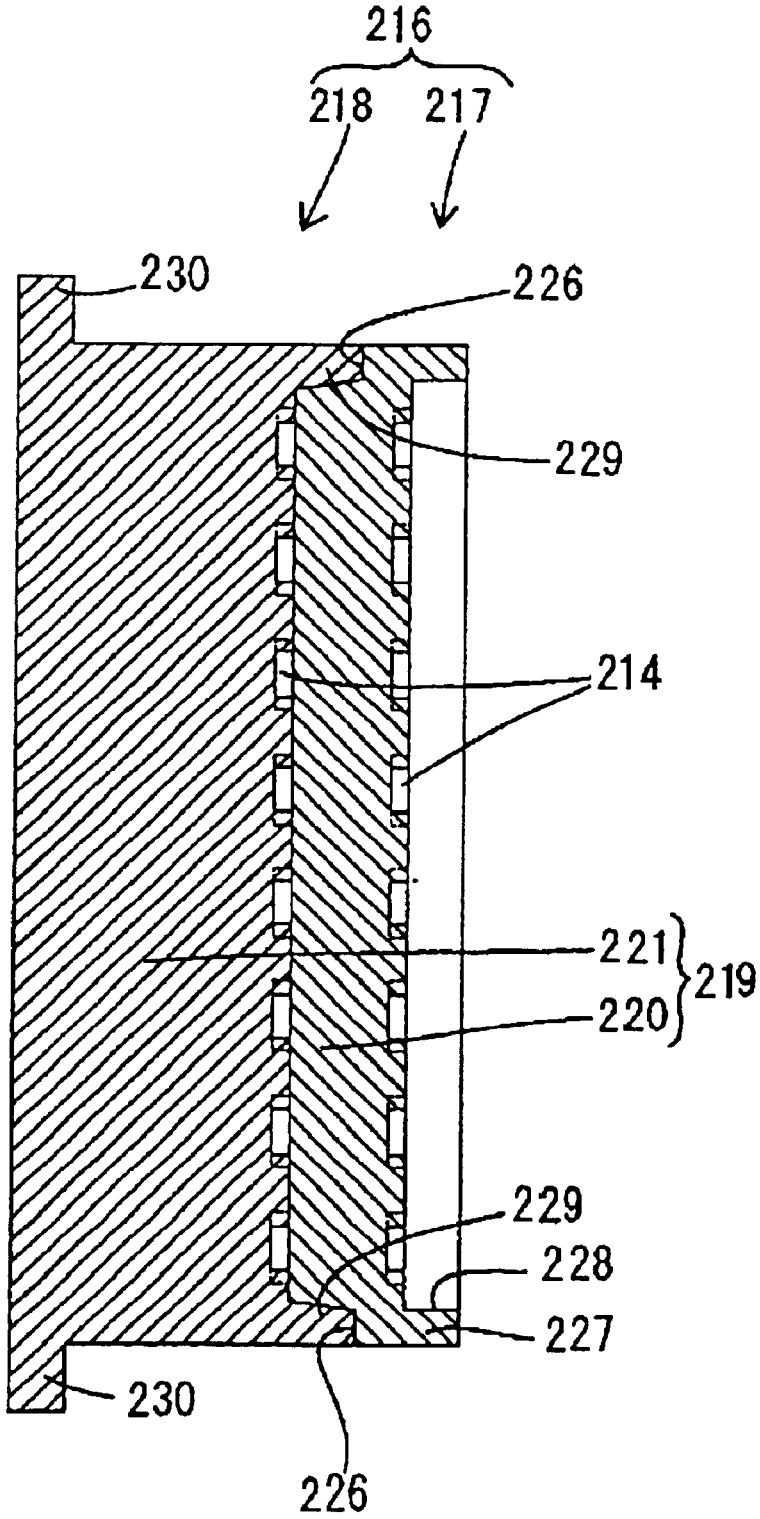
FIG. 22 is a horizontal sectional view of a single primary molding article that combines the first and second primary molding assemblies.

Briefly, a connector A in the second embodiment includes a resin molding portion 210 that is a square post-like configuration with open upper and lower ends, and a plurality of terminals 214 extending through a rectangular block 211 formed on an inner wall of the resin molding portion 210. The resin molding portion 210 and the terminals 214 are integrated with each other by means of insert molding. The connector A is formed initially from a linked terminal 213 that includes a plurality of terminals 214 and carriers 215 that connect the terminals 214, as shown in FIG. 14. The linked terminal 213 is integrated with primary molding resin elements 220 and 221 by means of primary insert molding to form two primary molding resin assemblies 217 and 218, as shown in FIGS. 15–17. The carriers 215 are cut in the respective assemblies 217 and 218 to separate the terminal members 214 from each other, as shown in FIG. 16. The two primary molding assemblies 217 and 218 having the cut carriers 215 are joined to form a primary molding article 216, as shown in FIG. 21. The primary molding article 216 then is integrated with a secondary molding resin portion 237 by means of secondary insert molding.

Figure 12:
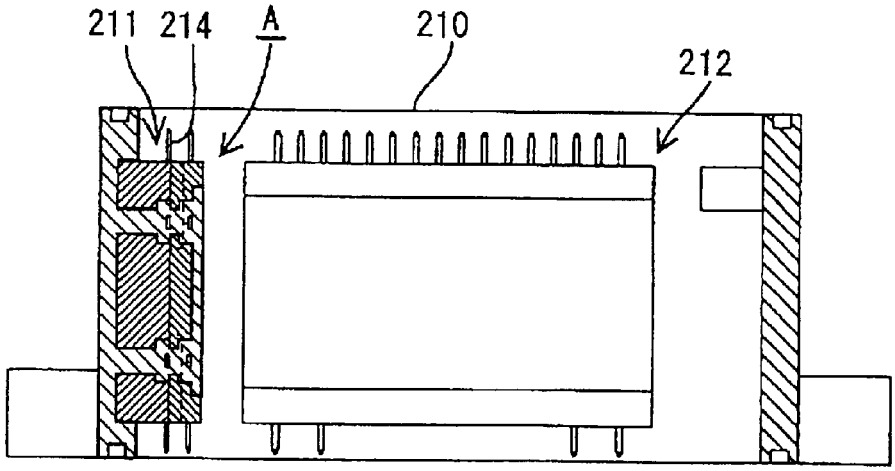
FIG. 12 is a cross sectional view of a second embodiment of a connector in accordance with the present invention.
Figure 13:
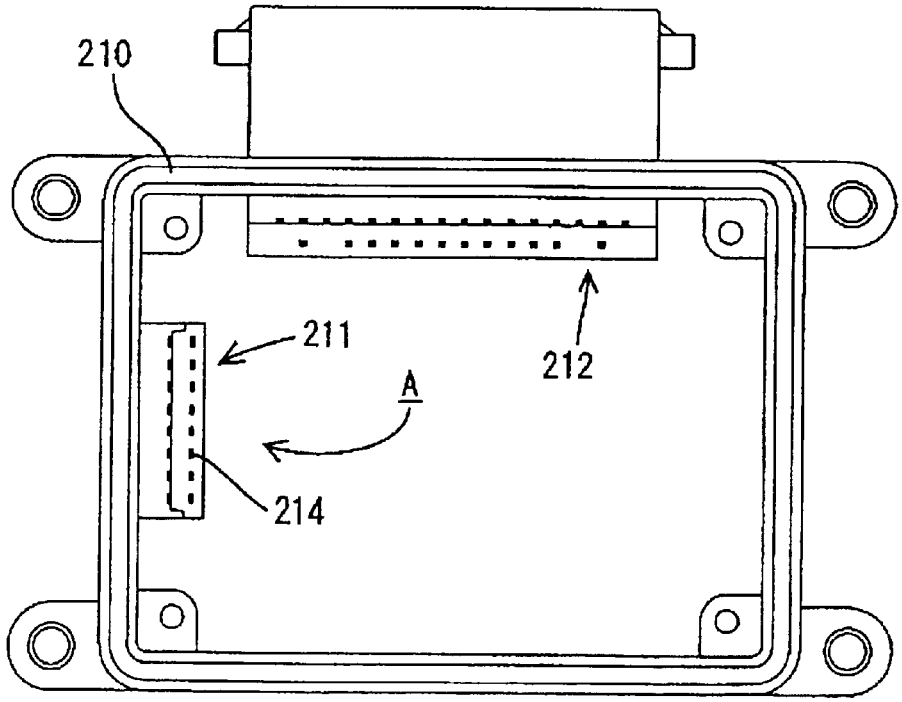
FIG. 13 is a plan elevation view of the embodiment shown in FIG. 12.

A process for producing the connector will be described below in detail. The rectangular block 211 disposed in the left side in FIGS. 12 and 13 is explained below. A rectangular block 212 disposed in the upper side in FIG. 13 is formed by the same insert molding the block 211. Accordingly, the explanation of the block 212 will be omitted here. The lateral direction, as used herein, refers to the orientation shown in FIGS. 14 through 16, and "the inner side" refers to the right side in FIGS. 17 through 26.

As shown in FIGS. 14 and 15, the linked terminal 213 includes a plurality of terminals 214 juxtaposed at a given pitch and carriers 215 that connect the adjacent terminals 214 at upper and lower positions. Two linked terminals 213 are used in the rectangular block 211. Two molds (not shown) that have different shapes are used in primary insert molding. Each linked terminal 213 is set in each mold for primary molding. The respective linked terminals 213 are integrated with the respective primary molding resin elements 220 and 221 that define unitary matrices of nonconductive material surrounding portions of the linked terminals 213 to form first and second primary molding assemblies 217 and 218 (see FIGS. 17 to 20).

As shown in FIGS. 15 through 20, the first primary molding assembly 217 includes the primary molding resin element 220 having a rectangular, thick plate-like configuration. The linked terminal 213 is exposed in alignment with the inner surface of the primary molding resin element 220, and escape holes 222 are formed in positions corresponding to the respective carriers 215 in the primary molding resin element 220. Upper and lower ends 214A of the respective terminals 214 project from the primary molding resin element 220. The escape hole 222 is provided on an inner end of the inner wall with upper and lower latches 224 each having a stepped recess. The primary molding resin element 220 has upper and lower fitting grooves 226 that extend from the opposite side surfaces to the outer surfaces. The primary molding resin element 220 also has a frame part 227 extending along the peripheral edge and continuously over the upper and lower sides and right and left sides. The space enclosed by the frame part 227 defines a tray-like space 228 communicating with the escape holes 222.

Figure 20:
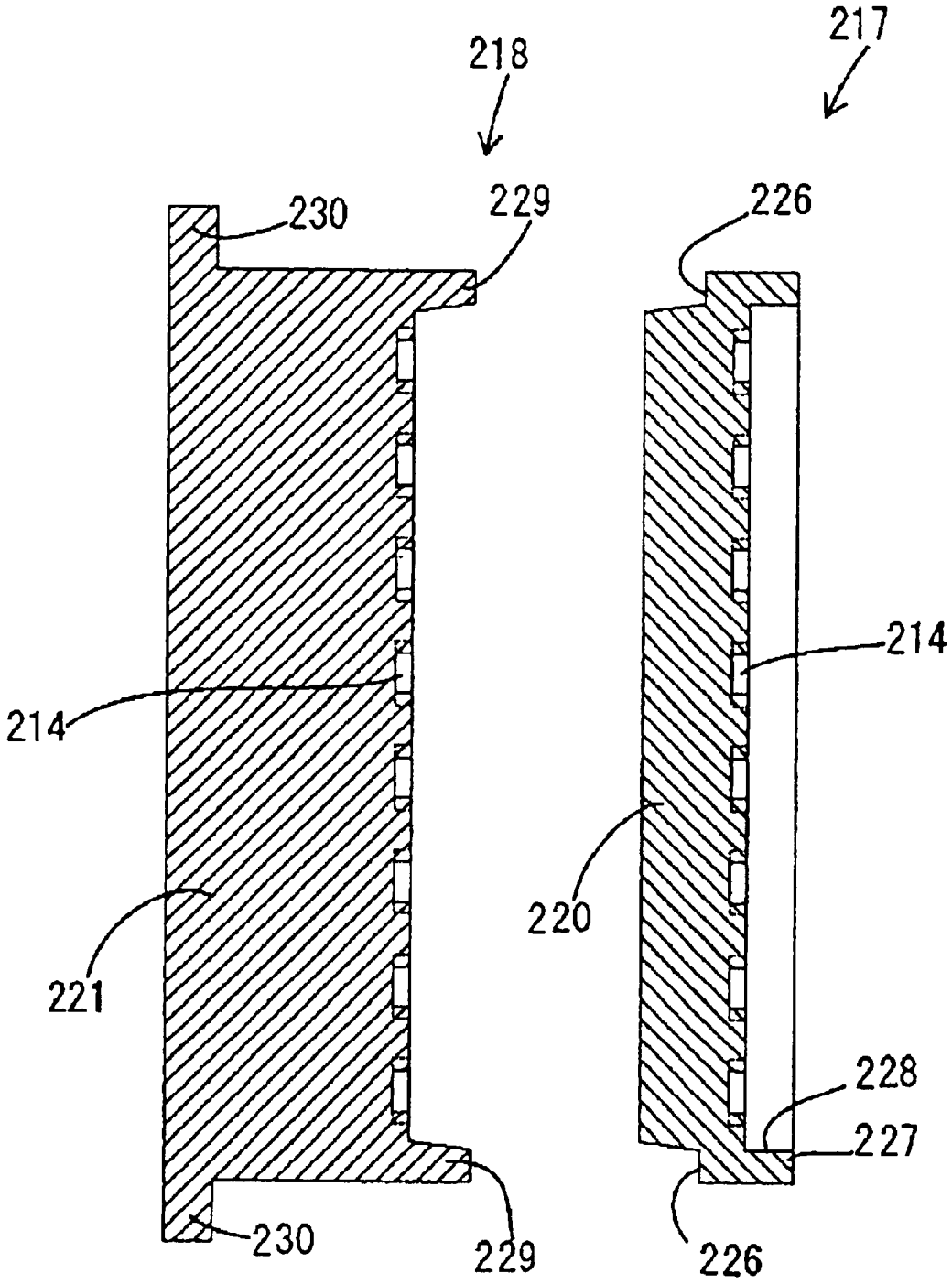
FIG. 20 is a horizontal sectional view of the first and second primary molding assemblies in the separated position.

The second primary molding assembly 218, as shown in FIGS. 17 through 20, is a generally rectangular shape. The linked terminal 213 is exposed in alignment with the inner surface of a plate-like primary molding resin element 221 that has a thickness greater than the first primary molding assembly 217. Upper and lower ends 214A of the respective terminal members 214 project from the primary molding resin element 221. Escape holes 223 are provided in the primary molding resin element 221 at positions corresponding to the respective carriers 215. Each escape hole 223 has upper and lower latches 225 on an inner end of the inner wall. Each latch 224 has a stepped recess. The primary molding resin element 221 has upper and lower fitting ribs 229 extending from the opposite side surfaces to the outer surface. The primary molding resin element 221 also has anti-dropout ribs 230 that extend laterally on the outer end surfaces on the opposite side surfaces (FIG. 20).

The respective carriers 215 are cut in the two primary molding assemblies 217 and 218 formed above. More particularly, cutters (not shown) enter the respective escape holes 222 and 223 to cut the respective carriers 215, thereby separating the adjacent terminal members 214 (see FIG. 16).

The first and second primary molding assemblies 217 and 218 that having had the respective carriers 215 cut are brought into close contact with the inner and outer surfaces in the axial directions of the escape holes 222 and 223. Upon their combination, the fitting grooves 226 are coupled to the fitting ribs 229, thereby integrating the primary molding resin elements 220 and 221 to form the primary molding resin portion 219. Thus, a single primary molding article 216 can be obtained (see FIGS. 21 and 22). In the completed primary molding article 216, the terminals 214 in the first primary molding assembly 217 are parallel to the terminals 214 in the second primary molding assembly 218 and the terminals 214 in both assemblies 217 and 218 are arranged to be piled in the axial directions (in the lateral direction in FIG. 21) of the escape holes 222 and 223. The escape holes 222 and 223 in the first and second primary molding assemblies 217 and 218 are registered and communicate with each other. The terminals 214 exposed on the inner surface of the second primary molding resin element 221 are covered with the first primary molding resin element 220.

Figure 23:
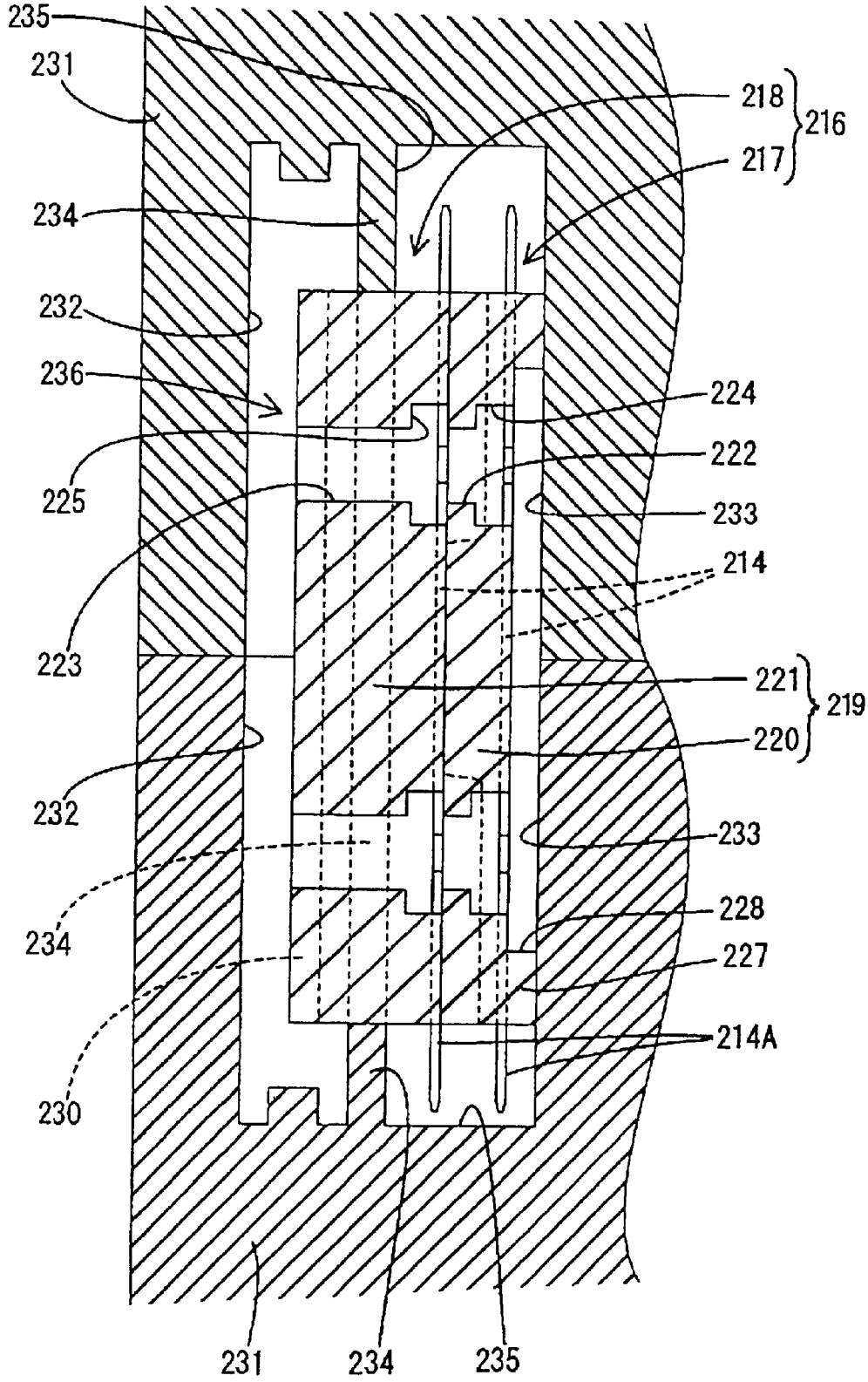
FIG. 23 is a longitudinal sectional view of the primary molding article set in a mold for secondary molding.

The primary molding article 216 is set in a mold 231 for secondary molding having a pair of upper and lower half mold bodies (see FIG. 23). The mold 231 for secondary molding includes a square frame-like molding space 232 for forming a secondary molding resin portion 237, a containing space 233 for accommodating the primary molding resin portion 219 of the primary molding article 16 without play, a clipping portion 234 that contacts the outer surface of the primary molding article 216, and a terminal containing concavity 235 for accommodating the ends 214A of the terminals 214 that project from the upper and lower surfaces of the primary molding resin portion 219 of the primary molding article 216.

When the primary molding article 216 is set in the mold 231 for secondary molding, the outer surface and anti-dropout ribs 230 of the primary molding resin portion 219 contained in the containing space 233 are disposed in the molding space 232. The clipping portion 234 engages the upper and lower end surfaces (the surface from which the ends 214A of the terminals 214 project) and the right and left side surfaces of the primary molding resin portion 219. Thus, a cavity 236 for secondary molding is enclosed by the outer surface of the primary molding resin portion 219 of the primary molding article 216 and the molding space 232 (the inner surface of the mold 231 for secondary molding) and is insulated from the terminal containing space 235. Since the clipping portion 234 engages the upper and lower surfaces and the right and left surfaces of the primary molding resin portion 219, the molten resin injected into the cavity 236 for secondary molding is prevented from leaking into the containing space 233 and terminal containing recess 235. The terminal containing recess 235 is not an elongated hole for fitting the end 214A of each terminal 214 but a laterally rectangular shape for containing the ends 214A of the terminals 214 together. The inner wall of the terminal containing recess 235 does not contact the ends 214A of the terminals 214.

Figure 24:
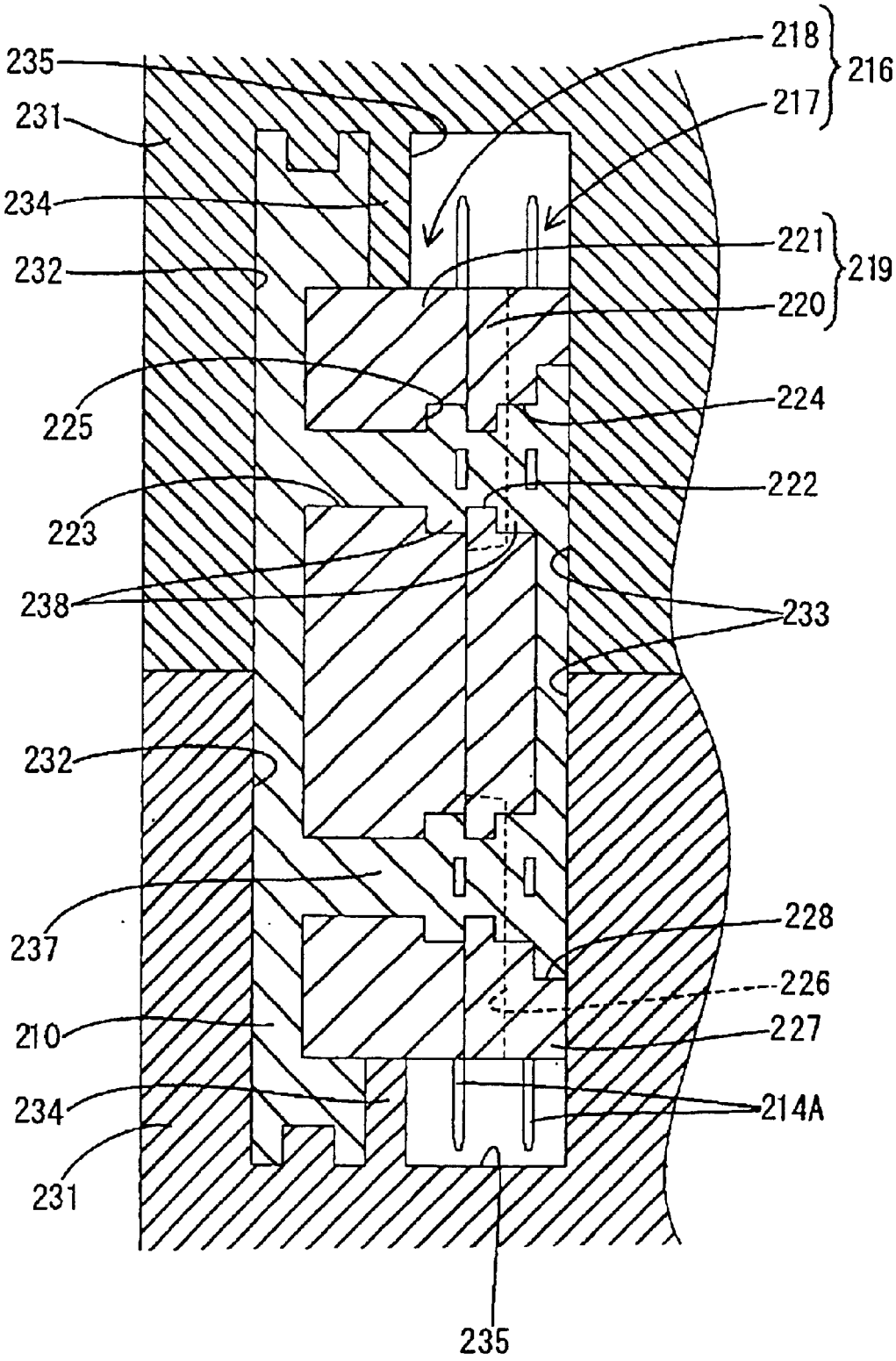
FIG. 24 is a longitudinal sectional view of a produced connector.
Figure 25:
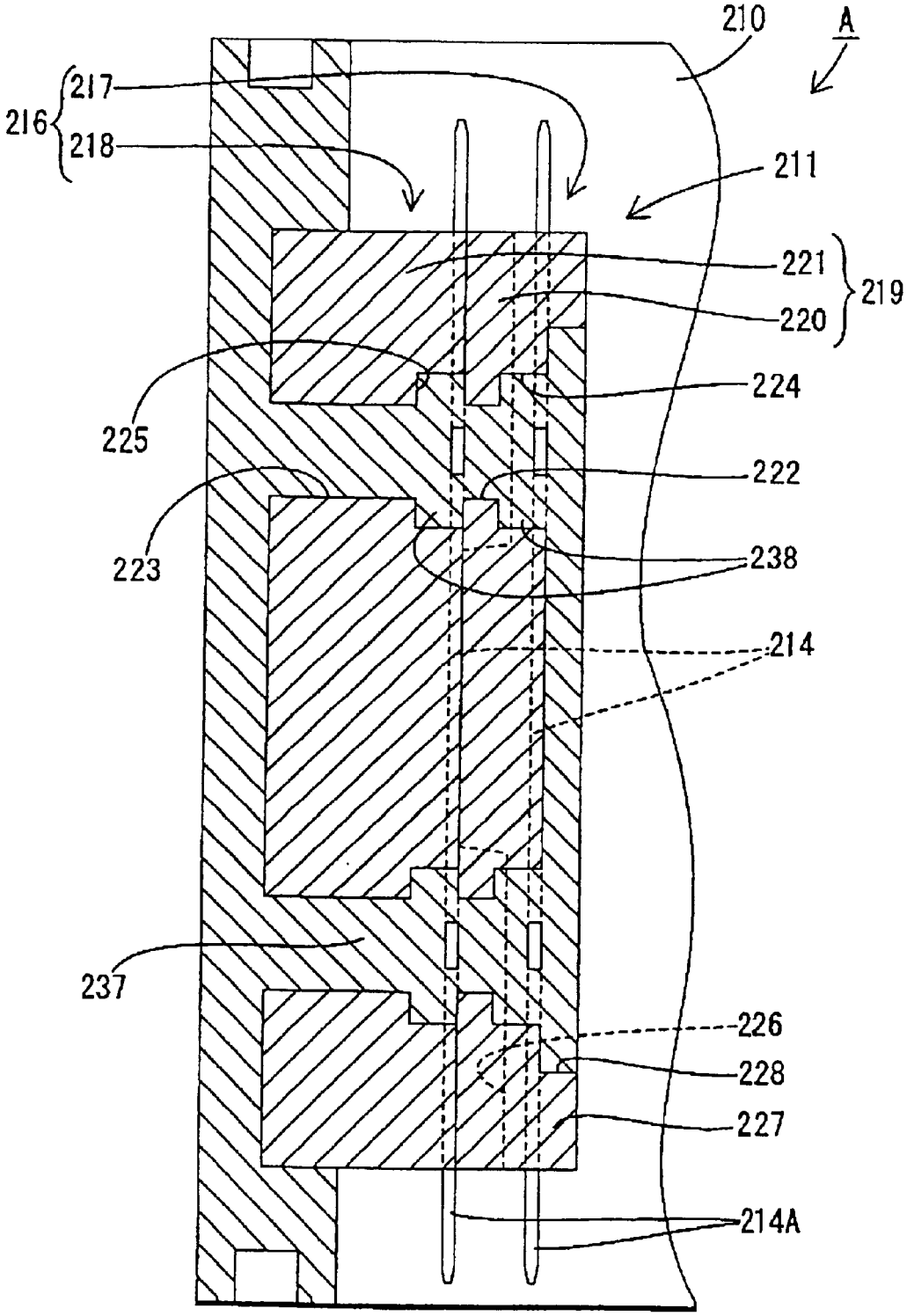
FIG. 25 is a partially enlarged longitudinal sectional view of the connector.

After the primary molding article 216 is set in the mold 231 for secondary molding, the molten resin is injected into the cavity 236 for secondary molding to form a secondary molding resin portion 237. The injected molten resin enters the respective escape holes 222 and 223 from the cavity 236 for secondary molding and further enters the tray-like space 228 in the interior of the primary molding resin portion 219. Secondary insert molding forms the secondary molding resin portion 237, as shown in FIG. 24, and defines a unitary matrix of nonconductive material. Consequently, the primary molding article 216 is integrated with the secondary molding resin portion 237 to obtain the connector A, as shown in FIG. 25. The primary molding resin portion 219 projecting inward from the secondary molding resin portion 237 defines the rectangular block 211. The ends 214A of the terminals 214 project from the upper and lower surfaces of the rectangular block 211.

Figure 26:
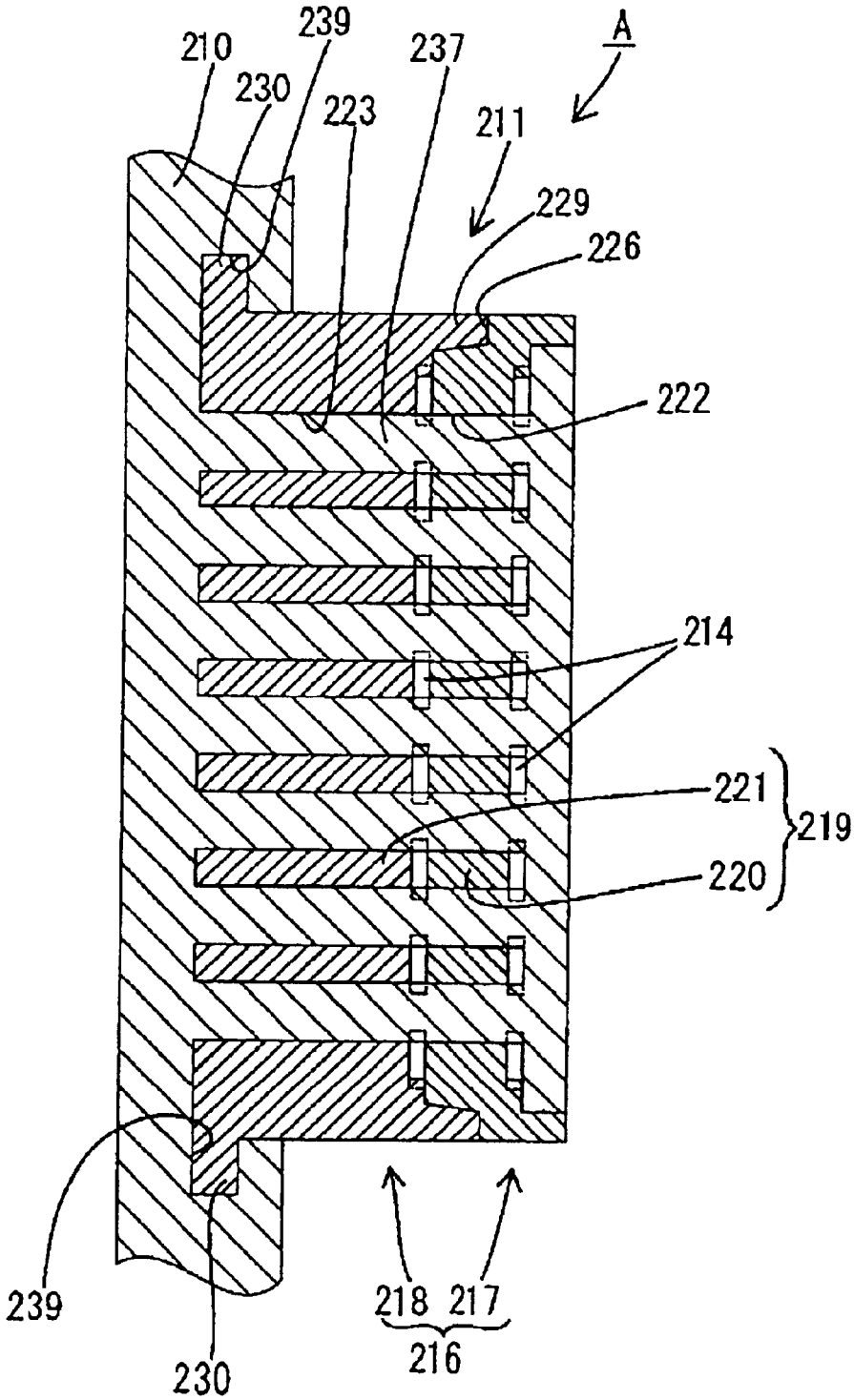
FIG. 26 is a partially enlarged horizontal sectional view of the connector.
Figure 27:
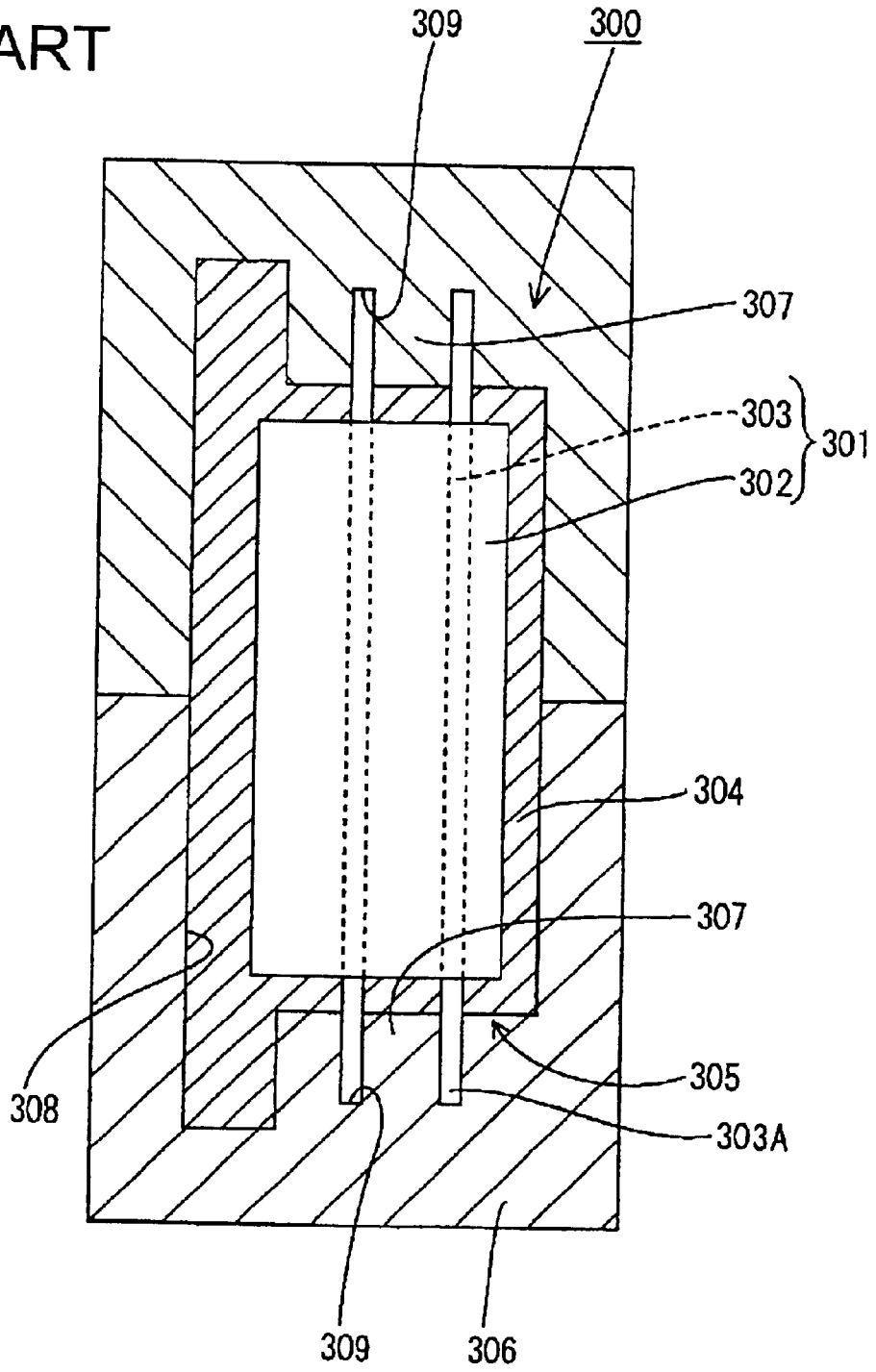
FIG. 27 PRIOR ART
FIG. 27 is a longitudinal sectional view of a prior art connector.

The secondary molding resin portion 237 is interposed between portions of the terminal members 214 that having had the carriers cut off 215, thereby insulating the adjacent terminals 214 (see FIG. 26). The latches 238 formed on the secondary molding resin portion 237 engage the latches 224 and 225 in the escape holes 222 and 223. Thus, the secondary molding resin portion 237 is prevented from coming out from the primary molding resin portion 219. The anti-dropout ribs 230 of the primary molding resin portion 219 engage the anti-dropout grooves 239. As a result, the secondary molding resin portion 237 is further prevented from coming out from the primary molding resin portion 219 (see FIG. 26). In addition, the exposed terminals 214 on the inner surface of the first primary molding resin element 220 are covered by a part of the secondary molding resin portion 237 that entered the tray-like space 228 (see FIG. 25). The interior of the part of the secondary molding resin portion 237 that entered the tray-like space 228 is continuously aligned with the interior of the frame part 227 of the primary molding resin portion 219.

The primary molding resin portion 219, the secondary molding resin portion 237, and the cavity 236 for secondary molding all are disposed on areas different from the projecting areas of the terminals 214. Additionally, the clipping portion 234 of the mold 231 for secondary molding engages the resin molding portion 210 at non-contact positions with the terminals 214. The engaging area of the clipping portion 234 on the upper and lower surfaces of the resin molding portion 210 is flat. Accordingly, the engaging area of the resin molding portion 210 on the clipping portion 234 is also flat. It is not necessary to provide the clipping portion 234 with elongated holes for receiving the ends 214A of the terminals 214. Thus, the present embodiment can avoid a complicated structure of the mold for secondary molding that would be required for a complicated structure of the clipping portion. A molding pressure exerted upon secondary insert molding is not applied to the ends 214A of the terminal 214. As a result, the terminals 214 are not deformed.

The plural terminals 214 can be set in the mold for primary insert molding in a form of the linked terminal 213. Therefore, the present invention has better workability than the conventional process in which the plural terminals are set in the mold one by one.

In addition, since the carriers 215 are cut in the escape holes 222 and 223, it is not necessary to remove a part of the primary molding resin portion 219 in connection with the cutting-off process of the carriers 215, thereby eliminating waste of materials.

The secondary molding resin portion 237 is interposed between the terminals 214 separated by cutting the carriers 215 and insulates the cut-off terminal members 214. Consequently, it is possible to insulate the respective cut-off terminals.

The primary molding resin portion 219 is coupled to the secondary molding resin portion 237 at the outer surface in which the outer end of the escape holes 223 is open. Since the escape holes 222 and 223 and secondary molding resin portion 237 are provided with the latches 224, 225 and 238 that engage each other. Hence, it is possible to restrain the primary and secondary molding resin portions 219 and 237 from separating from each other.

The plural terminal members could be piled in the axial directions of the escape holes when the primary molding portions of the primary molding article are formed as a single piece. However, it will be impossible to open the mold, since the terminal members interfere with the escape holes. However, in the present embodiment, the two primary molding assemblies 217 and 218 in which the terminals 214 and primary molding resin elements 220 and 221 are integrated by primary insert molding are piled in the axial directions of the escape holes to form the primary molding article 216. Consequently, it is not necessary to align the plural terminals in the axial directions of the escape holes 222 and 223. The terminals do not interfere with the opening action of the mold that form the escape holes 222 and 223 in the primary molding resin elements 220 and 221.

The terminals in the linked form are integrated with the primary molding resin portions in primary insert molding in the above embodiment. Accordingly, terminals that are not coupled to each other by carriers may be coupled to the primary molding resin portions in accordance with the present invention.

Although the primary molding article is provided with the escape holes for cutting off the carriers in the above embodiment, the carriers may be put on thin parts of the primary molding resin portions so that the carriers are cut along with the thin parts in accordance with the present invention.

The escape holes in the primary molding article are provided with the latches with which the secondary molding resin portion is engaged in the above embodiment. The latches may be provided in another areas except for the escape holes in accordance with the present invention.

Although the plural terminals are piled in the axial directions of the escape holes in the above embodiment, the plural terminals may not be piled in the axial directions of the escape holes in accordance with the present invention. In this case, primary molding resin elements may be formed as a single part.

From the above description of the invention, those skilled in the art will perceive improvements, changes and modifications. Such improvements, changes and modifications within the skill of the art are intended to be covered by the appended claims.

The entire disclosures of Japanese Patent Application Nos. 2001-221631 and 2001-242797 filed on Jul. 23, 2001 and Aug. 9, 2001 including specifications, claims, drawings and summaries are incorporated herein by reference in their entireties.

What is claimed is:

1. A connector comprising:

a plurality of spaced-apart terminals (121; 214), each of said terminals (121; 214) having opposite first and second ends (214*a*) and at least one carrier (124*a*; 215) intermediate the ends (214*a*), the carrier (124*a*; 215) of each of said terminals (121; 214) being bent for avoiding contact with other of said terminals (121; 214);

a primary molding portion (110*a*; 220, 221) defining a unitary matrix of nonconductive material surrounding portions of each of said terminals (121; 214) between the first end (214*a*) and the carrier (124*a*; 215) and surrounding portions of each of said terminals (121; 214) between the second end (214*a*) and the carrier (124*a*; 214), such that the carrier (124*a*; 215) of each of said terminals (121; 214) and portions of each of said terminals (121; 214) adjacent the first and second ends (214*a*) are not surrounded by the primary molding portion (110; 220, 221); and a secondary molding portion (110*b*; 237) defining a unitary matrix of nonconductive material surrounding the carriers (124*a*; 215) of each of said terminals (121; 214) and surrounding portions of the primary molding portion (110*a*; 220, 221).

2. The connector of claim 1, wherein the primary molding portion (220, 221) is exposed adjacent the first and second ends (214*a*) of each of said terminals (214).

3. The connector of claim 1, wherein the terminals (214) define a first plurality of terminals (214), and wherein the primary molding (220) defines a first primary molding (220), the connector further comprising a second plurality of terminals (214) and a second primary molding (221), each of said terminals (214) in said second plurality having opposite first and second ends (214*a*) and a carrier (215) intermediate the ends (214*a*), the carriers (215) of the terminals (214) in the second plurality being bent for avoiding contact with other of said terminals (214), the second primary molding (221) defining a unitary matrix of nonconductive material surrounding portions of the terminals (214) in the second plurality spaced from the carriers (215) thereof and spaced from the first and second ends (214*a*) thereof, the secondary molding (237) surrounding the carriers (215) of both said first and second pluralities of terminals (214) and portions of said first and second primary moldings (220, 221).

4. The connector of claim 3, wherein the carriers (215) of the second plurality of said terminals (214) align respectively with the carriers (215) of the first plurality of the terminals (214).

5. The connector of claim 3, wherein the first and second primary moldings (220, 221) are configured for nesting with one another.

6. The connector of claim 1, wherein the primary molding (110*a*) is substantially frame-shaped and is in spaced surrounding relationship to the carriers (124*a*).

7. A method for producing a connector comprising:

providing a linked terminal (120; 213) having a plurality of terminals (121; 214) joined unitarily to each other by carriers (124; 215), molding a primary nonconductive material (110*a*; 220, 221) around portions of said linked terminal (120; 213) spaced from said carriers (124; 215), cutting through each of said carriers (124; 215) to form cut carrier sections (124*a*) projecting from the respective terminals (121; 214), bending said cut carrier sections (124*a*) to separate adjacent terminals (121; 214) from each other, and molding a secondary nonconductive material (110*b*; 237) around the cut carrier sections (124*a*) and around at least portions of the molded primary nonconductive material (110*a*; 220, 221).

8. The method of claim 7, wherein the cutting step is performed without generating chips from said linked terminal (120; 213).

9. The method of claim 8, wherein the bending step is formed continuously with the cutting step.

10. The method of claim 9, wherein the cutting step comprises supporting the linked terminal (120; 213) in proximity to the carriers (124; 215).

11. The method of claim 7, wherein the step of molding the primary nonconductive material (110*a*; 220, 221) comprises placing portions of the linked terminal (120; 213) spaced from the carriers (124; 215) and spaced from the ends (214*a*) in a primary mold cavity, and injecting a resin material into the primary mold cavity.

12. The method of claim 11, wherein the step of molding the primary nonconductive material (110*a*; 220, 221) comprises molding at least one escape hole (112; 222) surrounding the carriers (124; 215), and wherein the cutting of the carriers (124; 215) comprises moving a cutter (131) into the escape hole (112; 222).

13. The method of claim 12, wherein the step of molding the primary nonconductive material (220, 221) produces a primary molded article (217, 218), the method further comprising piling a plurality of the primary molded articles (217, 218) on one another and then molding the secondary nonconductive material around the piled primary molded articles (217; 218).

14. The method of claim 7, wherein the step of molding the secondary nonconductive material (110*b*; 237) comprises placing the molded primary nonconductive material (110*a*; 220, 221) and portions of the terminals (121; 214) in a secondary mold cavity that has clipping portions for isolating the ends (214*a*) of the terminals (121; 214) from the secondary mold cavity, and injecting a resin material into the secondary mold cavity.

* * * * *